US009573737B2

(12) United States Patent
Bonekamp et al.

(10) Patent No.: US 9,573,737 B2
(45) Date of Patent: Feb. 21, 2017

(54) FLEXIBLE CONTAINER WITH A SPRAY VALVE

(71) Applicant: Dow Global Technologies LLC, Midland, MI (US)

(72) Inventors: Jeffrey E. Bonekamp, Midland, MI (US); Cristina Serrat, Freeport, TX (US); Matthew J. Turpin, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 23 days.

(21) Appl. No.: 14/840,784

(22) Filed: Aug. 31, 2015

(65) Prior Publication Data

US 2016/0304254 A1 Oct. 20, 2016

Related U.S. Application Data

(60) Provisional application No. 62/147,819, filed on Apr. 15, 2015.

(51) Int. Cl.
*B65D 47/20* (2006.01)
*B65D 75/00* (2006.01)
(Continued)

(52) U.S. Cl.
CPC ..... *B65D 47/2018* (2013.01); *B65D 35/10* (2013.01); *B65D 35/28* (2013.01); *B65D 75/008* (2013.01);
(Continued)

(58) Field of Classification Search
CPC ..... B65D 47/2018; B65D 35/28; B65D 35/10; B65D 83/0061; B65D 75/008; B65D 75/5883
(Continued)

(56) References Cited

U.S. PATENT DOCUMENTS 2,738,227 A 3/1956 Havens
2,816,691 A * 12/1957 Ward ..... B05B 9/047 222/183
(Continued)

FOREIGN PATENT DOCUMENTS

GB 2153011 A 8/1985
WO 2012/117401 A1 9/2012
(Continued)

*Primary Examiner* — Donnell Long
(74) *Attorney, Agent, or Firm* — Husch Blackwell LLP

(57) ABSTRACT

The present disclosure provides a device. In an embodiment, a device for dispensing a fluid under pressure is provided and includes:

(A) a flexible container comprising four panels, each panel formed from a flexible multilayer film composed of one or more polymeric materials, the four panels forming
  (i) a body, and
  (ii) a neck;
(B) a fitment comprising a top portion and a base, the base composed of a polymeric material, the base sealed in the neck;
(C) a sleeve bag on valve assembly (SBoV) comprising
  (i) a valve housing,
  (ii) a core tube attached to the valve housing,
  (iii) a bag around the core tube, the bag attached to the valve housing,
  (iv) a sleeve surrounding the bag and the core tube, and
  (v) a valve seat;
(D) the SBoV inserted through the fitment and located in the body; and
(E) the valve seat attached to the fitment.

18 Claims, 8 Drawing Sheets

(51) Int. Cl.
*B65D 75/58* (2006.01)
*B65D 83/00* (2006.01)
*B65D 35/10* (2006.01)
*B65D 35/28* (2006.01)

(52) U.S. Cl.
CPC ..... *B65D 75/5883* (2013.01); *B65D 83/0061* (2013.01)

(58) Field of Classification Search
USPC ..... 222/209, 212, 131, 94, 95, 105, 321.1,222/402.1, 183
IPC ..... B65D 47/2018,35/28, 35/10, 83/0061, 75/008, 75/5883
See application file for complete search history.

(56) References Cited

U.S. PATENT DOCUMENTS 3,672,543 A 6/1972 Roper et al.
3,705,667 A * 12/1972 Blanie ..... B65D 83/54 222/136
3,796,356 A 3/1974 Venus, Jr.
3,961,725 A 6/1976 Clark
4,041,851 A * 8/1977 Jentsch ..... B29C 66/1122 383/107
4,121,737 A * 10/1978 Kain ..... B65D 83/0061 222/212
4,222,499 A * 9/1980 Lee ..... B65D 83/0061 222/183
4,251,032 A 2/1981 Werding
4,387,833 A * 6/1983 Venus, Jr. ..... B65D 83/0061 222/105
4,718,778 A * 1/1988 Ichikawa ..... B65D 75/5883 220/705
4,964,540 A 10/1990 Katz
5,111,971 A * 5/1992 Winer ..... B65D 83/0061 222/105
5,143,263 A * 9/1992 Newell ..... B65D 83/303 222/105
5,232,126 A * 8/1993 Winer ..... B65D 83/0061 222/386.5
5,783,638 A 7/1998 Lai
5,788,121 A * 8/1998 Sasaki ..... B65D 77/065 222/105
5,927,551 A 7/1999 Taylor et al.
6,126,315 A * 10/2000 Ichikawa ..... B65D 31/10 383/104
6,413,239 B1 7/2002 Burns et al.
6,695,757 B2 * 2/2004 Edwards ..... B31B 19/74 493/218
6,921,204 B2 * 7/2005 Edwards ..... B65D 33/02 222/105
7,086,570 B2 8/2006 Canegallo
8,231,029 B2 7/2012 Peer et al.
8,348,509 B2 * 1/2013 Wilkes ..... B65D 75/008 383/10
8,454,882 B2 6/2013 Chan et al.
8,505,774 B2 8/2013 Nimmo et al.
8,752,731 B2 6/2014 Nimmo et al.
2006/0243741 A1 11/2006 Schiefer
2010/0308077 A1 * 12/2010 Sonntag ..... B65D 83/62 222/95
2011/0056965 A1 3/2011 Peer et al.
2013/0345647 A1 12/2013 Har-Shai
2014/0061244 A1 3/2014 Kertels

FOREIGN PATENT DOCUMENTS

WO 2014/111939 A2 7/2014
WO 2014/111940 A1 7/2014

* cited by examiner

FLEXIBLE CONTAINER WITH A SPRAY VALVE

CROSS-REFERENCE TO RELATED APPLICATIONS

This application claims priority to U.S. Patent Application Ser. No. 62/147,819 filed on 15 Apr. 2015, the entire content of which is incorporated by reference herein.

BACKGROUND

The present disclosure is directed to a flexible container with a spray valve, and a flexible container with a propellant-free pressurized dispensing system in particular.

Flexible packaging is known to offer significant value and sustainability benefits to product manufacturers, retailers and consumers as compared to rigid, molded plastic packaging or metal containers. Flexible packaging provides many consumer conveniences and benefits, including extended shelf life, easy storage, microwavability and refillability. Flexible packaging has proven to require less energy for creation and creates fewer emissions during disposal.

Flexible packaging includes flexible containers with a gusseted body section. These gusseted flexible containers are currently produced using flexible films which are folded to form gussets and heat sealed in a perimeter shape. The gusseted body section opens to form a flexible container with a square cross section or a rectangular cross section. The gussets are terminated at the bottom of the container to form a substantially flat base, providing stability when the container is partially or wholly filled. The gussets are also terminated at the top of the container to form an open neck for receiving a rigid fitment and closure.

Known are bag-on-valve (BoV) dispensing systems that utilize an elastic sleeve disposed around a fluid-filled inner bag. Actuation of the valve triggers contraction of the elastic sleeve which expels the fluid contents from the bag without a propellant. A drawback of conventional BoV systems is the use of outer enclosures that are rigid, and typically made from rigid plastic, or metal.

A need exists for a flexible container that can spray deliver a fluid composition under pressure. A need further exists for a flexible container that can spray deliver a fluid composition under pressure and also reduce raw material and shipping costs, improve recyclability after product is depleted, and reduce waste volume and disposal costs.

SUMMARY

The present disclosure provides a device for dispensing a fluid under pressure and with no propellant. The spray system of the present disclosure can deliver a propellant-free aerosol spray of product.

The present disclosure provides a device. In an embodiment, a device for dispensing a fluid under pressure is provided and includes:

(A) a flexible container comprising four panels, each panel formed from a flexible multilayer film composed of one or more polymeric materials, the four panels forming (i) a body, and (ii) a neck;

(B) a fitment comprising a top portion and a base, the base composed of a polymeric material, the base sealed in the neck;

(C) a sleeve bag on valve assembly (SBoV) comprising (i) a valve housing, (ii) a core tube attached to the valve housing, (iii) a bag around the core tube, the bag attached to the valve housing, (iv) a sleeve surrounding the bag and the core tube, and (v) a valve seat;

(D) the SBoV inserted through the fitment and located in the body; and (E) the valve seat attached to the fitment.

In an embodiment, the flexible container for the device is a large volume flexible container.

DETAILED DESCRIPTION

The present disclosure provides a device. In an embodiment, a device for dispensing a fluid under pressure is provided and includes:

(A) a flexible container comprising four panels, each panel formed from a flexible multilayer film composed of one or more polymeric materials, the four panels forming (i) a body, and (ii) a neck;

(B) a fitment comprising a top portion and a base, the base composed of a polymeric material, the base sealed in the neck;

(C) a sleeve bag on valve assembly (SBoV) comprising (i) a valve housing, (ii) a core tube attached to the valve housing, (iii) a bag around the core tube, the bag attached to the valve housing, (iv) a sleeve surrounding the bag and the core tube, and (v) a valve seat;

(D) the SBoV is inserted through the fitment and located in the body; and (E) the valve seat attached to the fitment.

1. Flexible Container

Figure 1:
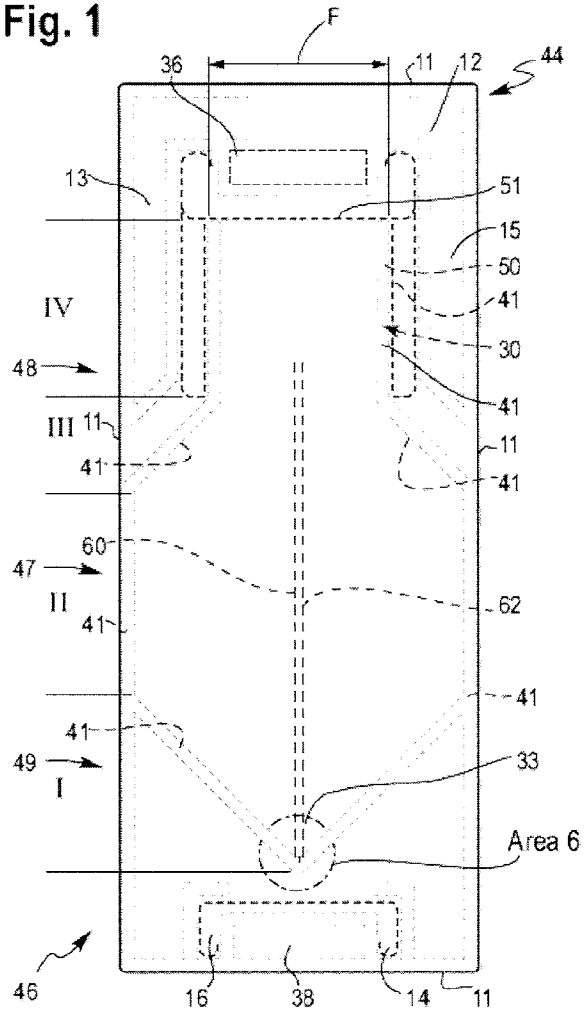
FIG. 1 is a front elevation view of a flexible container in a collapsed configuration in accordance with an embodiment of the present disclosure.

The device 4 includes a flexible container. The flexible container includes panels, each panel composed of a flexible multilayer film. The flexible container can be made from two, three, four, five, six, or more panels. In an embodiment, the flexible container 10 has a collapsed configuration (as shown in FIG. 1) and has an expanded configuration (shown in FIGS. 3, 4, 5). FIG. 1 shows the flexible container 10 having a bottom section I, a body section II, a tapered transition section III, and a neck section IV. In the expanded configuration, the bottom section I forms a bottom segment 26. The body section II forms a body portion. The tapered transition section III forms a tapered transition portion. The neck section IV forms a neck portion.

In an embodiment, the flexible container 10 is made from four panels as shown in FIGS. 1-6. During the fabrication process, the panels are formed when one or more webs of film material are sealed together. While the webs may be separate pieces of film material, it will be appreciated that any number of the seams between the webs could be "pre-made," as by folding one or more of the source webs to create the effect of a seam or seams. For example, if it were desired to fabricate the present flexible container from two webs instead of four, the bottom, left center, and right center webs could be a single folded web, instead of three separate webs. Similarly, one, two, or more webs may be used to produce each respective panel (i.e., a bag-in-a-bag configuration or a bag configuration).

Figure 2:
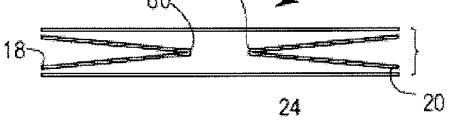
FIG. 2 is an exploded side elevation view of a panel sandwich.

FIG. 2 shows the relative positions of the four webs as they form four panels (in a "one up" configuration) as they pass through the fabrication process. For clarity, the webs are shown as four individual panels, the panels separated and the heat seals not made. The constituent webs form first gusset panel 18, second gusset panel 20, front panel 22 and rear panel 24. The panels 18-24 are a multilayer film as discussed in detail below. The gusset fold lines 60 and 62 are shown in FIGS. 1 and 2.

As shown in FIG. 2, the folded gusset panels 18, 20 are placed between the rear panel 24 and the front panel 22 to form a "panel sandwich." The gusset panel 18 opposes the gusset panel 20. The edges of the panels 18-24 are configured, or otherwise arranged, to form a common periphery 11 as shown in FIG. 1. The flexible multilayer film of each panel web is configured so that the heat seal layers face each other. The common periphery 11 includes the bottom seal area including the bottom end of each panel.

When the flexible container 10 is in the collapsed configuration, the flexible container is in a flattened state, or in an otherwise evacuated state. The gusset panels 18, 20 fold inwardly (dotted gusset fold lines 60, 62 of FIG. 1) and are sandwiched by the front panel 22 and the rear panel 24.

Figure 4:
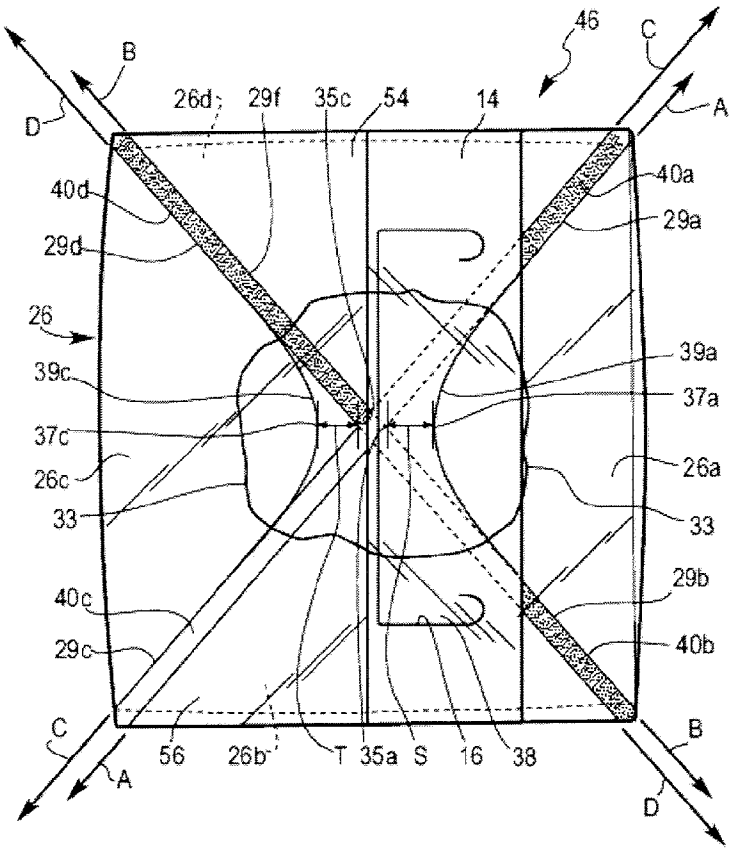
FIG. 4 is a bottom plan view of the expanded flexible container of FIG. 3 in accordance with an embodiment of the present disclosure.
Figure 3:
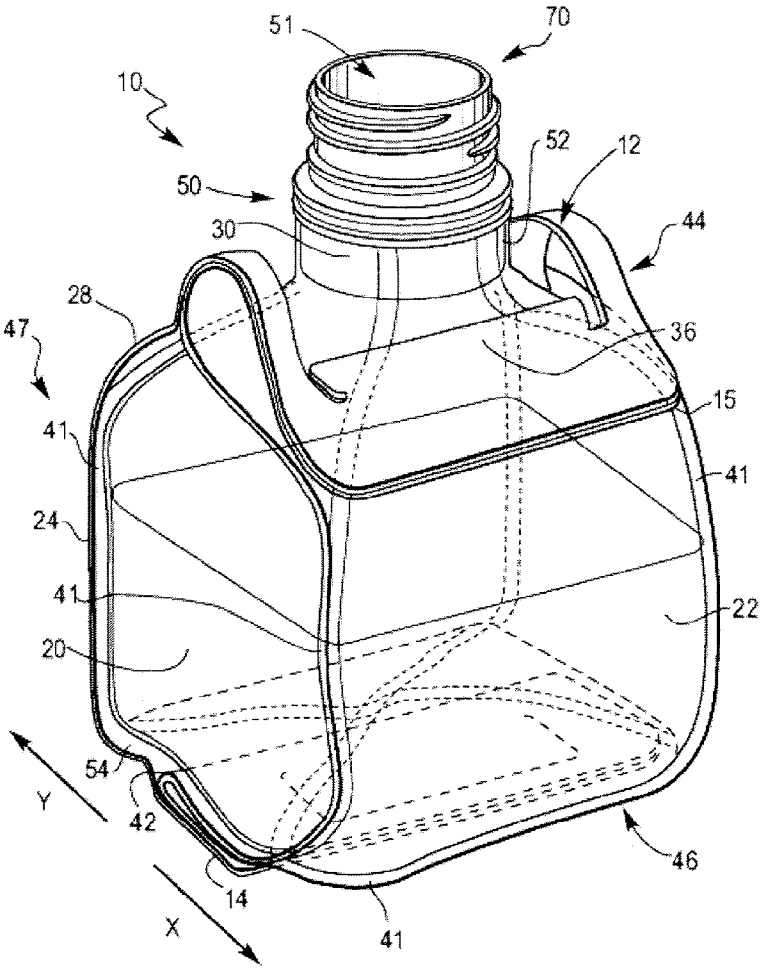
FIG. 3 is a perspective view of the flexible container of FIG. 1 in an expanded configuration and in accordance with an embodiment of the present disclosure.
Figure 5:
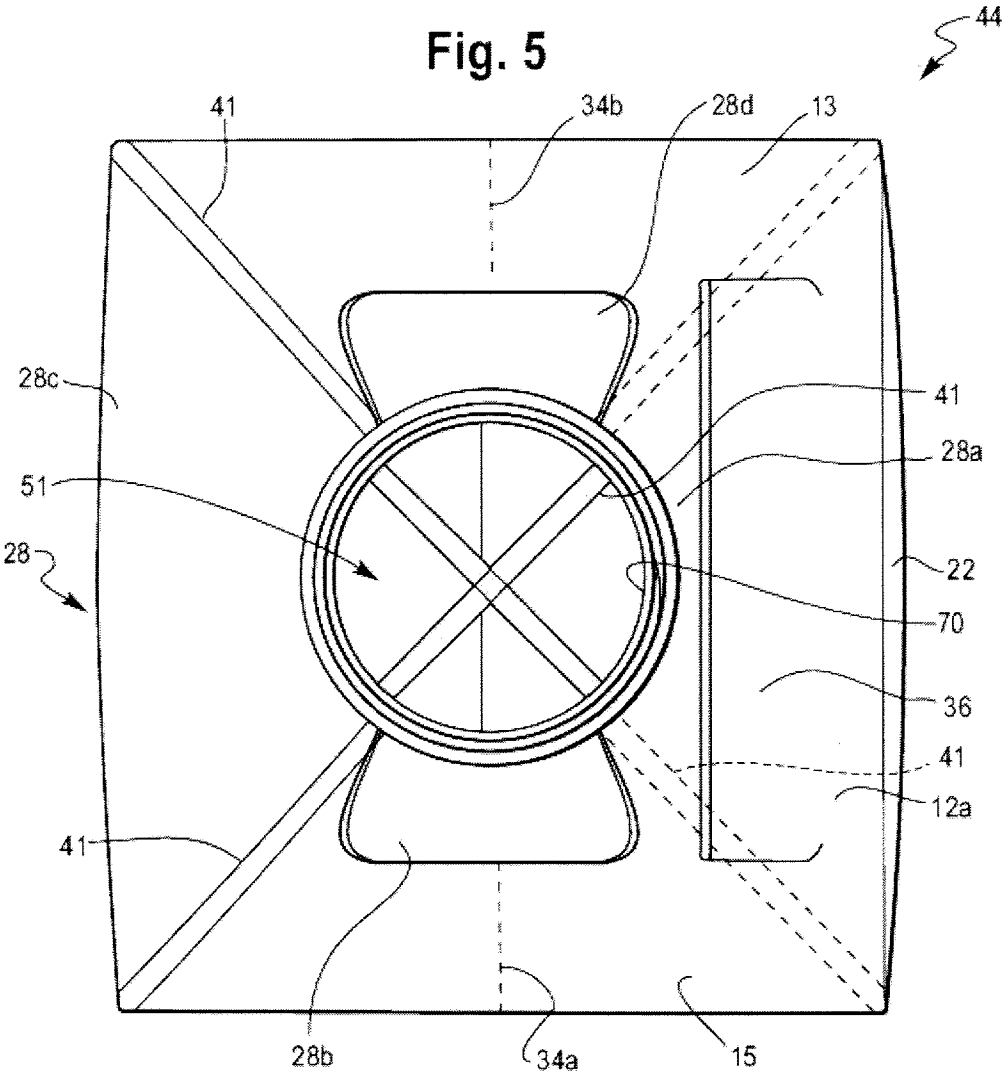
FIG. 5 is a top plan view of the flexible container of FIG. 3.

FIGS. 3-5 show flexible container 10 in the expanded configuration. The flexible container 10 has four panels, a front panel 22, a back panel 24, a first gusset panel 18 and a second gusset panel 20. The four panels 18, 20, 22, and 24 form the body section II and extend toward a top end 44 and extend toward a bottom end 46 of the container 10. Sections III and IV (respective tapered transition section, neck section) form a top segment 28. Section I (bottom section) forms a bottom segment 26.

The four panels 18, 20, 22 and 24 can each be composed of a separate web of film material. The composition and structure for each web of film material can be the same or different. Alternatively, one web of film material may also be used to make all four panels and the top and bottom segments. In a further embodiment, two or more webs can be used to make each panel.

In an embodiment, four webs of film material are provided, one web of film for each respective panel 18, 20, 22, and 24. The process includes sealing edges of each film to the adjacent web of film to form peripheral seals 41 (FIGS. 1, 3, 4, 5). The peripheral tapered seals 40*a*-40*d* are located on the bottom segment 26 of the container as shown in FIG. 4. The peripheral seals 41 are located on the side edges of the container 10. Consequently the process includes forming a closed bottom section I, a closed body section II, and a closed tapered transition section III.

To form the top segment 28 and the bottom segment 26, the four webs of film converge together at the respective end and are sealed together. For instance, the top segment 28 can be defined by extensions of the panels sealed together at the tapered transition section III, and the neck section IV. The top end 44 includes four top panels 28*a*-28*d* (FIG. 5) of film that define the top segment 28. The bottom segment 26 can be defined by extensions of the panels sealed together at the bottom section I. The bottom segment 26 can also have four bottom panels 26*a*-26*d* of film sealed together and can also be defined by extensions of the panels at the opposite end 46 as shown in FIG. 4.

The neck portion can be located at a corner of the body 47, or in one of the four panels. In an embodiment, the neck 30 is positioned at a midpoint of the top segment 28. The neck 30 may (or may not) be sized smaller than a width of the body section III, such that the neck 30 can have an area that is less than a total area of the top segment 28.

In an embodiment, the neck is formed from two or more panels. In a further embodiment, the neck 30 is formed from four panels.

The neck can be shaped or sized to fit any size of fitment, such as a fitment having a diameter from 15 mm to 120 mm, for example. In an embodiment, the neck is sized to accommodate a wide-mouth fitment. A "wide-mouth fitment," is a fitment having a diameter greater than 50 mm.

Although FIGS. 1 and 3 show the flexible container 10 with a top handle 12 and a bottom handle 14, it is understood the flexible container may be fabricated without handles or with only one handle. When the flexible container has a top handle, the neck is located centered on the top segment between the handle bases to facilitate easy dispensing. When the container has a bottom handle, the container may be hung upside down for use in an alternate dispensing mode.

The four panels of film that form the flexible container 10 extend from the body section II (forming body 47), to the tapered transition section III (forming tapered transition portion 48), to form a neck 30 (in the neck section IV). The four panels of film also extend from the body section II to the bottom section I (forming bottom portion 49). When the flexible container 10 is in the collapsed configuration (FIG. 1), the neck 30 has a width that is less than the width of the tapered transition section III. The neck 30 includes a neck wall 50. FIGS. 1 and 3 show the neck wall 50 forms an open end 51 for access into the flexible container interior. The panels are sealed together to form a closed bottom section, a closed body section, and a closed tapered transition section. Nonlimiting examples of suitable heating procedures include heat sealing and/or ultrasonic sealing. In an embodiment, the seal has a width from 2 mm to 16 mm, or 9 mm.

When the flexible container 10 is in the expanded configuration, the open end 51 of the neck wall 50 is open or is otherwise unsealed. When the flexible container 10 is in the collapsed configuration, the open end 51 is unsealed and is openable. The open end 51 permits access to the container interior through the neck wall 50 and the neck 30 as shown in FIGS. 3 and 5.

As shown in FIGS. 1, 3-4, the flexible bottom handle 14 can be positioned at a bottom end 46 of the container 10 such that the bottom handle 14 is an extension of the bottom segment 26.

Each panel includes a respective bottom face. FIG. 4 shows four triangle-shaped bottom faces 26*a*-26*d*, each bottom face being an extension of a respective film panel. The bottom faces 26*a*-26*d* make up the bottom segment 26. The four panels 26*a*-26*d* come together at a midpoint of the bottom segment 26. The bottom faces 26*a*-26*d* are sealed together, such as by using a heat-sealing technology, to form the bottom handle 14. For instance, a weld can be made to form the bottom handle 14, and to seal the edges of the bottom segment 26 together. Nonlimiting examples of suitable heat-sealing technologies include hot bar sealing, hot die sealing, impulse sealing, high frequency sealing, or ultrasonic sealing methods.

Figure 6:
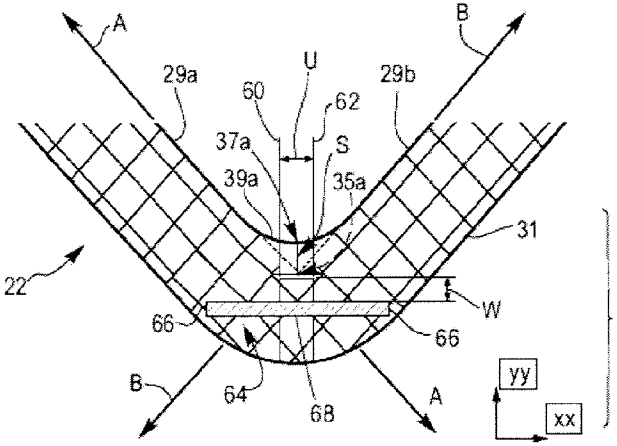
FIG. 6 is an enlarged view of area 6 of FIG. 1.

FIG. 4 shows bottom segment 26. Each panel 18, 20, 22, 24 has a respective bottom face 26*a*-26*d* that is present in the bottom segment 26. Each bottom face is bordered by two opposing peripheral tapered seals 40*a*-40*d*. Each peripheral tapered seal 40*a*-40*d* extends from a respective peripheral seal 41. The peripheral tapered seals for the front panel 22 and the rear panel 24 have an inner edge 29*a*-29*d* (FIG. 4) and an outer edge 31 (FIG. 6). The peripheral tapered seals 40*a*-40*d* converge at a bottom seal area 33 (FIG. 1, FIG. 4, FIG. 6).

The front panel bottom face 26*a* includes a first line A defined by the inner edge 29*a* of the first peripheral tapered seal 40*a* and a second line B defined by the inner edge 29*b* of the second peripheral tapered seal 40*b*. The first line A intersects the second line B at an apex point 35*a* in the bottom seal area 33. The front panel bottom face 26*a* has a bottom distalmost inner seal point 38 ("BDISP 38"). The BDISP 38 is located on the inner edge.

The apex point 35*a* is separated from the BDISP 38 by a distance S from 0 millimeter (mm) to less than 8.0 mm.

In an embodiment, the rear panel bottom face 26*c* includes an apex point similar to the apex point on the front panel bottom face. The rear panel bottom face 26*c* includes a first line C defined by the inner edge of the 29*c* first peripheral tapered seal 40*c* and a second line D defined by the inner edge 29*d* of the second peripheral tapered seal 40*d*. The first line C intersects the second line D at an apex point 35*c* in the bottom seal area 33. The rear panel bottom face 26*c* has a bottom distalmost inner seal point 37*c* ("BDISP 37*c*"). The BDISP 37*c* is located on the inner edge. The apex point 35*c* is separated from the BDISP 37*c* by a distance T from 0 millimeter (mm) to less than 8.0 mm.

It is understood the following description to the front panel bottom face applies equally to the rear panel bottom face, with reference numerals to the rear panel bottom face shown in adjacent closed parentheses.

In an embodiment, the BDISP 38 (37*c*) is located where the inner edges 29*a* (29*c*) and 29*b* (29*d*) intersect. The distance between the BDISP 38 (37*c*) and the apex point 35*a* (35*c*) is 0 mm.

Figure 8:
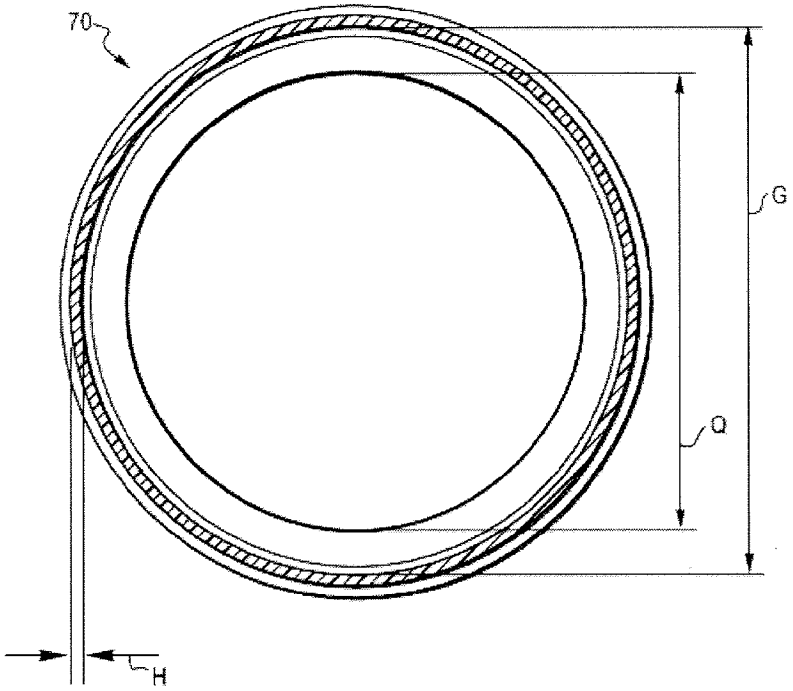
FIG. 8 is a bottom plan view of the fitment of FIG. 7.

In an embodiment, the inner seal edge diverges from the inner edges 29*a*, 29*b* (29*c*, 29*d*), to form an inner seal arc 39*a* (front panel) and inner seal arc 39*c* (rear panel) as shown in FIGS. 4 and 8. The BDISP 38 (37*c*) is located on the inner seal arc 39*a* (39*c*). The apex point 35*a* (apex point 35*c*) is separated from the BDISP 38 (BDISP 37*c*) by the distance S (distance T) which is from greater than 0 mm, or 0.5 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.3 mm, or 5.5 mm, or 6.0 mm, or 6.5 mm, or 7.0 mm, or 7.5 mm, or 7.9 mm.

In an embodiment, apex point 35*a* (35*c*) is separated from the BDISP 38 (37*c*) by the distance S (distance T) which is from greater than 0 mm to less than 6.0 mm.

In an embodiment, the distance from S (distance T) from the apex point 35*a* (35*c*) to the BDISP 38 (37*c*) is from greater than 0 mm, or 0.5 mm or 1.0 mm, or 2.0 mm to 4.0 mm or 5.0 mm or less than 5.5 mm.

In an embodiment, apex point 35*a* (apex point 35*c*) is separated from the BDISP 38 (BDISP 37*c*) by the distance S (distance T) which is from 3.0 mm, or 3.5 mm, or 3.9 mm to 4.0 mm, or 4.5 mm, or 5.0 mm, or 5.2 mm, or 5.3 mm, or 5.5 mm.

In an embodiment, the distal inner seal arc 39*a* (39*c*) has a radius of curvature from 0 mm, or greater than 0 mm, or 1.0 mm to 19.0 mm, or 20.0 mm.

In an embodiment, each peripheral tapered seal 40*a*-40*d* (outside edge) and an extended line from respective peripheral seal 41 (outside edge) form an angle G as shown in FIG. 1. The angle G is from 40°, or 42°, or 44°, or 45° to 46°, or 48°, or 50°. In an embodiment, angle G is 45°.

The bottom segment 26 includes a pair of gussets 54 and 56 formed there at, which are essentially extensions of the bottom faces 26*a*-26*d*. The gussets 54 and 56 can facilitate the ability of the flexible container 10 to stand upright. These gussets 54 and 56 are formed from excess material from each bottom face 26*a*-26*d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26*a*-26*b* and 26*b*-26*c*. The gussets 54 and 56 can contact a portion of the bottom segment 26, where the gusset portions gussets 54 and 56 can contact bottom faces 26*b* and 26*d* covering them, while bottom segment panels 26*a* and 26*c* remain exposed at the bottom end 46.

As shown in FIGS. 3-4, the gussets 54 and 56 of the flexible container 10 can further extend into the bottom handle 14. In the aspect where the gussets 54 and 56 are positioned adjacent bottom segment panels 26*b* and 26*d*, the bottom handle 14 can also extend across bottom faces 26*b* and 26*d*, extending between the pair of panels 18 and 20. The bottom handle 14 can be positioned along a center portion or midpoint of the bottom segment 26 between the front panel 22 and the rear panel 24.

The top handle 12 and the bottom handle 14 can comprise up to four plys of film sealed together for a four panel container 10. When more than four panels are used to make the container, the handles can include the same number of panels used to produce the container. Any portion of the handles 12, 14 where all four plys are not completely sealed together by the heat-sealing method, can be adhered together in any appropriate manner, such as by a tack seal to form a fully-sealed multilayer handle. Alternatively, the top handle can be made from as few as a single ply of film from one panel only or can be made from only two plies of film from two panels. The handles 12, 14 can have any suitable shape and generally will take the shape of the film end. For example, typically the web of film has a rectangular shape when unwound, such that its ends have a straight edge. Therefore, the handles 12, 14 would also have a rectangular shape.

Additionally, the bottom handle 14 can contain a handle opening 16 or cutout section therein sized to fit a user's hand, as can be seen in FIG. 1. The handle opening 16 can be any shape that is convenient to fit the hand and, in one aspect, the handle opening 16 can have a generally oval shape. In another embodiment, the handle opening 16 can have a generally rectangular shape. Additionally, the handle opening 16 of the bottom handle 14 can also have a flap 38 that comprises the cut material that forms the handle opening 16. To define the handle opening 16, the handle 14 can have a section that is cut out of the multilayer handle 14 along three sides or portions while remaining attached at a fourth side or lower portion. This provides a flap of material 38 that can be pushed through the opening 16 by the user and folded over an edge of the handle opening 16 to provide a relatively smooth gripping surface at an edge that contacts the user's hand. If the flap of material were completely cut out, this would leave an exposed fourth side or lower edge that could be relatively sharp and could possibly cut or scratch the hand when placed there.

Furthermore, a portion of the bottom handle 14 attached to the bottom segment 26 can contain a machine fold 42 or a score line that provides for the handle 14 to consistently fold in the same direction, as illustrated in FIG. 3. The machine fold 42 can comprise a fold line that permits folding in a first direction toward the front side panel 22 and restricts folding in a second direction toward the rear panel 24. The term "restricts" as used throughout this application can mean that it is easier to move in one direction, or the first direction, than in an opposite direction, such as the second direction. The machine fold 42 can cause the handle 14 to consistently fold in the first direction because it can be thought of as providing a generally permanent fold line in the handle that is predisposed to fold in the first direction X, rather than in the second direction Y. This machine fold 42 of the bottom handle 14 can serve multiple purposes, one being that the container 10 has a more uniform appearance. Secondly, when the flexible container 10 is stored in an upright position, the machine fold 42 in the bottom handle 14 encourages the handle 14 to fold in the first direction X along the machine fold 42, such that the bottom handle 14 can fold underneath the container 10 adjacent one of the bottom segment panels 26*a*, as shown in FIG. 4. As will be discussed herein, the top handle 12 can also contain a similar machine fold that also allows it to fold consistently in the same first direction X as the bottom handle 14.

Additionally, as the SBoV in the flexible container 10 is evacuated and less fluid composition remains in the bag, the bottom handle 14 can continue to provide support to assist the flexible container 10 to remain standing upright unsupported and without tipping over. Because the bottom handle 14 is sealed generally along its entire length extending between the pair of gusset panels 18 and 20, it can help to keep the gussets 54 and 56 (FIG. 3, FIG. 4) together and continue to provide support to stand the container 10 upright even as the container 10 is emptied.

As seen in FIGS. 1, 3, and 5, the top handle 12 can extend from the top segment 28 and, in particular, can extend from the four panels 28*a*-28*d* that make up the top segment 28. The four panels 28*a*-28*d* of film that extend into the top handle 12 are all sealed together to form a multilayer top handle 12. The top handle 12 can have a U-shape and, in particular, an upside down U-shape with a horizontal upper handle portion 12*a* having two pairs of spaced legs 13 and 15 extending therefrom. The pair of legs 13 and 15 extend from the top segment 28, adjacent the neck 30.

A portion of the top handle 12 can extend above the neck 30 and above the top segment 28 when the handle 12 is extended in a position perpendicular to the top segment 28 and, in particular, the entire upper handle portion 12*a* can be above the neck wall 50 and the top segment 28. The two pairs of legs 13 and 15 along with the upper handle portion 12*a* together make up the handle 12 surrounding a handle opening that allows a user to place their hand therethrough and grasp the upper handle portion 12*a* of the handle 12.

As with the bottom handle 14, the top handle 12 also can have a dead machine fold that permits folding in a first direction toward the front side panel 22 and restricts folding in a second direction toward the rear side panel 24. The machine fold can be located in each of the pair of legs 13, 15 at a location where the seal begins. The handle 12 can be adhered together, such as with a tack adhesive, for example. The machine fold in the handle 12 can allow for the handle 12 to be inclined to fold or bend consistently in the same first direction X as the bottom handle 14, rather than in the second direction Y. As shown in FIGS. 1, 3, and 5, the handle 12 can likewise contain a flap portion 36, that folds upwards toward the upper handle portion 12*a* of the handle 12 to create a smooth gripping surface of the handle 12, as with the bottom handle 14, such that the handle material is not sharp and can protect the user's hand from getting cut on any sharp edges of the handle 12.

When the flexible container 10 is in a rest position, such as when it is standing upright on its bottom segment 26, as shown in FIG. 3, the bottom handle 14 can be folded underneath the container 10 along the bottom machine fold 42 in the first direction X, so that it is parallel to the bottom segment 26 and adjacent bottom panel 26*a*, and the top handle 12 will automatically fold along Its machine fold in the same first direction X, with a front surface of the handle 12 parallel to a top section or panel 28*a* of the top segment 28. The top handle 12 folds in the first direction X, rather than extending straight up, perpendicular to the top segment 28, because of the machine fold. Both handles 12 and 14 are inclined to fold in the same direction X, such that upon dispensing, the handles can fold the same direction, relatively parallel to its respective end panel or end segment, to make dispensing easier and more controlled. Therefore, in a rest position, the handles 12 and 14 are both folded generally parallel to one another. Additionally, the container 10 can stand upright even with the bottom handle 14 positioned underneath the upright container 10.

The flexible container with SBoV also can be supported by the front panel, rear panel, or a gusset panel—i.e., when the flexible container (with SBoV) is standing on either the front panel, the rear panel, or one of the gusset panels. The handles (if present) contribute to stability when the flexible container is in this configuration. In an embodiment, the flexible container (with SBoV) can be designed to stand on a front/rear panel when the front panel or rear panel has an area that is greater than three times the area of the bottom segment.

The material of construction of the flexible container 10 can comprise food-grade plastic. For instance, nylon, polypropylene, polyethylene such as high density polyethylene (HDPE) and/or low density polyethylene (LDPE) may be used as discussed later. The film of the plastic container 10 can have a thickness and barrier properties that is adequate to maintain product and package integrity during manufacturing, distribution, product shelf life and customer usage.

In an embodiment, the flexible multilayer film has a thickness from 100 micrometers, or 200 micrometers, or 250 micrometers to 300 micrometers, or 350 micrometers, or 400 micrometers.

In an embodiment, the film material can also be such that it provides the appropriate atmosphere within the flexible container 10 to maintain the product shelf life of at least about 180 days. Such films can comprise an oxygen barrier film, such as a film having a low oxygen transmission rate (OTR) from greater than 0 to 0.4 cc/$m^2$/atm/24 hrs at 23° C. and 80% relative humidity (RH). Additionally, the flexible multilayer film can also comprise a water vapor barrier film, such as a film having a low water vapor transmission rate (WVTR) from greater than 0 to 15 g/$m^2$/24 hrs at 38° C. and 90% RH. Moreover, it may be desirable to use materials of construction having oil and/or chemical resistance particularly in the seal layer, but not limited to just the seal layer. The flexible multilayer film can be either printable or compatible to receive a pressure sensitive label or other type of label for displaying of indicia on the flexible container 10. In an embodiment the film can also be made of non-food grade resins for producing containers for materials other than food.

In an embodiment, each panel is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers or core layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

The flexible multilayer film is composed of one or more polymeric materials. Nonlimiting examples of suitable polymeric materials for the seal layer include olefin-based polymer (including any ethylene/$C_3$-$C_{10}$ α-olefin copolymers linear or branched), propylene-based polymer (including plastomer and elastomer, random propylene copolymer, propylene homopolymer, and propylene impact copolymer), ethylene-based polymer (including plastomer and elastomer, high density polyethylene ("HDPE"), low density polyethylene ("LDPE"), linear low density polyethylene ("LLDPE"), medium density polyethylene ("MDPE"), ethylene-acrylic acid or ethylene-methacrylic acid and their ionomers with zinc, sodium, lithium, potassium, magnesium salts, ethylene vinyl acetate copolymers and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene and copolymers of ethylene (such as HDPE or LLDPE based on ethylene octene copolymer such as DOWLEX™ or metallocene copolymers such as ELITE™ enhanced polyethylene), blends thereof, and multilayer combinations thereof.

Nonlimiting examples of suitable polymeric materials for the tie layer include metallocene copolymers of ethylene such as ELITE™ enhanced polyethylene, functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical performance such as stiffness or opacity, as well polymers which may offer gas barrier properties or chemical resistance can be added to the structure.

In an embodiment, the flexible multilayer film includes a seal layer selected from LLDPE (sold under the trade name DOWLEX™ (The Dow Chemical Company)), single-site LLDPE substantially linear, or linear ethylene alpha-olefin copolymers, including polymers sold under the trade name AFFINITY™ or ELITE™ (The Dow Chemical Company) for example, propylene-based plastomers or elastomers such as VERSIFY™ (The Dow Chemical Company), and blends thereof. An optional tie or core layer is selected from either ELITE™ enhanced polyethylene, ethylene-based olefin block copolymer PE-OBC (sold as INFUSE™) or propylene-based olefin block copolymer PP-OBC (sold as INTUNE™). The outer layer includes greater than 50 wt % of resin(s) having a melting point, Tm, that is from 25° C., to 30° C., or 40° C. or higher than the melting point of the polymer in the seal layer wherein the outer layer polymer is selected from resins such as VERSIFY or VISTAMAX, ELITE™, HDPE or a propylene-based polymer such as propylene homopolymer, propylene impact copolymer or TPO.

In an embodiment, the flexible multilayer film is a coextruded and/or laminated five layer, or a coextruded (or laminated) seven layer film having at least one layer containing a material selected from LLDPE, OPET, OPP (oriented polypropylene), BOPP, and polyamide.

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has a ΔTm from 40° C. to 200° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

FIG. 6 shows an enlarged view of the bottom seal area 33 (area 6) of FIG. 1 and the front panel 26*a*. The fold lines 60 and 62 of respective gusset panels 18, 20 are separated by a distance U that is from 0 mm, or greater than 0 mm, or 0.5 mm, or 1.0 mm, or 2.0 mm, or 3.0 mm, or 4.0 mm, or 5.0 mm to 12.0 mm, or greater than 60.0 mm (for larger containers, for example). In an embodiment, distance U is from greater than 0 mm to less than 6.0 mm. FIG. 6 shows line A (defined by inner edge 29*a*) intersecting line B (defined by inner edge 29*b*) at apex point 35*a*. BDISP 38 is on the distal inner seal arc 39*a*. Apex point 35*a* is separated from BDISP 38 by S having a length from greater than 0 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.5 mm, or 6.0 mm, or 6.5 mm, or 7.0 mm, or 7.5 mm, or 7.9 mm.

In FIG. 6, an overseal 64 is formed where the four peripheral tapered seals 40*a*-40*d* converge in the bottom seal area. The overseal 64 includes 4-ply portions 66, where a portion of each panel is heat sealed to a portion of every other panel. Each panel represents 1-ply in the 4-ply heat seal. The overseal 64 also includes a 2-ply portion 68 where two panels (front panel and rear panel) are sealed together. Consequently, the "overseal," as used herein, is the area where the peripheral tapered seals converge that is subjected to a subsequent heat seal operation (and subjected to at least two heat seal operations altogether). The overseal is located in the peripheral tapered seals and does not extend into the chamber of the flexible container 10.

In an embodiment, the apex point 35*a* is located above the overseal 64. The apex point 35*a* is separated from, and does not contact the overseal 64. The BDISP 38 is located above the overseal 64. The BDISP 38 is separated from and does not contact the overseal 64.

In an embodiment, the apex point 35*a* is located between the BDISP 38 and the overseal 64, wherein the overseal 64 does not contact the apex point 35*a* and the overseal 64 does not contact the BDISP 38.

The distance between the apex point 35*a* to the top edge of the overseal 64 is defined as distance W shown in FIG. 6. In an embodiment, the distance W has a length from 0 mm, or greater than 0 mm, or 2.0 mm, or 4.0 mm to 6.0 mm, or 8.0 mm, or 10.0 mm or 15.0 mm.

When more than four webs are used to produce the container, the portion 68 of the overseal 64 may be a 4-ply, or a 6-ply, or an 8-ply portion.

In an embodiment, the flexible container 10 has a volume from 0.050 liters (L), or 0.1 L, or 0.15 L, or 0.2 L, or 0.25 L, or 0.5 L, or 0.75 L, or 1.0 L, or 1.5 L, or 2.5 L, or 3 L, or 3.5 L, or 3.75 L, or 4.0 L, or 4.5 L, or 5.0 L to 6.0 L, or 7.0 L, or 8.0 L, or 9.0 L, or 10.0 L, or 20 L, or 30 L.

In an embodiment, the flexible container 10 is a large volume flexible container. A "large volume flexible container" is a flexible container having an expanded volume from 1.0 L, or greater than 1.0 L, or 2.0 L, or 3.0 L, or 4.0 L, or 5.0 L, or 10 L to 20 L, or 25 L, or 30 L.

2. Fitment

Figure 7:
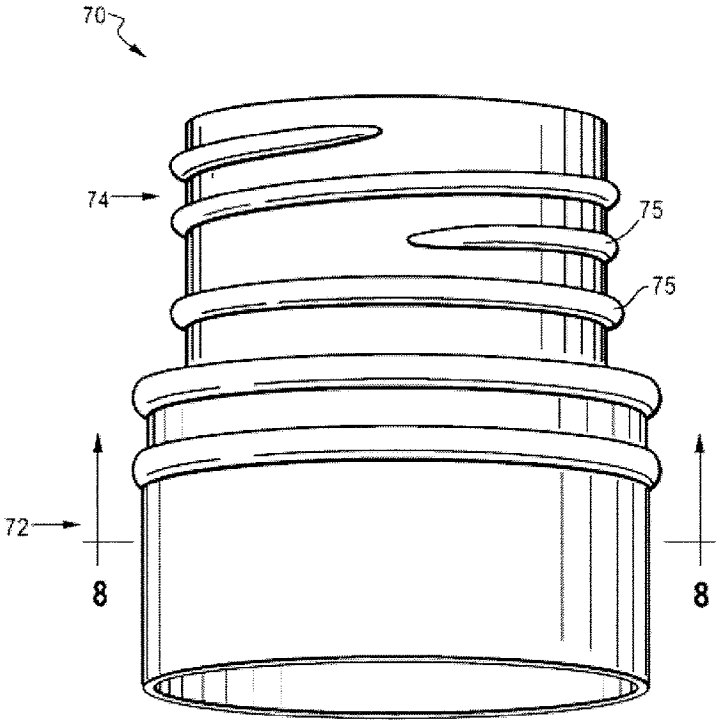
FIG. 7 is an elevation view of a fitment in accordance with an embodiment of the present disclosure.
Figure 9:
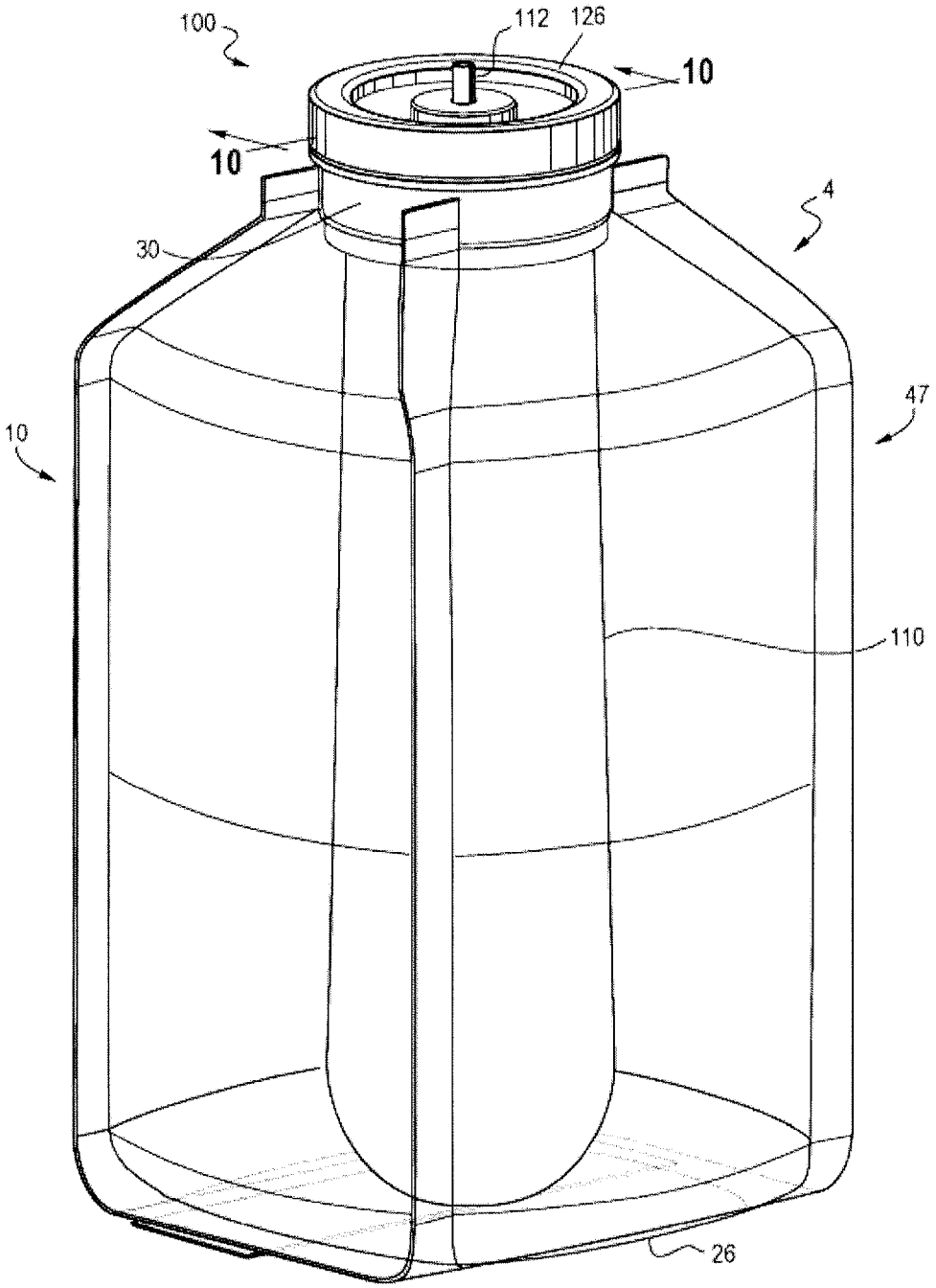
FIG. 9 is a perspective view of the device including a flexible container and a sleeve bag on valve assembly (SBoV) in accordance with an embodiment of the present disclosure.

In an embodiment, the flexible container includes a fitment inserted into the neck of the flexible container. The fitment 70 includes a base 72 and a top portion 74 as shown in FIG. 7. The fitment is composed of one or more polymeric materials. The base 72 and the top portion 74 may be made from the same polymeric material or from different polymeric materials. In an embodiment, the base 72 and the top portion 74 are made from the same polymeric material.

The top portion 74 may include threads 75 or other suitable structure for attachment to a valve providing closure to the container. Nonlimiting examples of suitable fitments, include threaded or having lip with an outside undercut for snap closure of the valve or other suitable cylindrical fitment for attaching to the SBoV. The valve and/or fitment may or may not include a gasket.

In an embodiment, the top portion 74 has a circular cross section with a diameter suitable to attach the SBoV. In an embodiment, the top portion diameter Q is 15 mm, or 17 mm, or 18 mm, or 19 mm, or 20 mm, or 21 mm, or 22 mm, or 23 mm, or 24 mm, or 25 mm, or 26 mm, or 27 mm, or 28 mm, or 30 mm, or 35 mm, or 40 mm, or 45 mm, or 50 mm, or 60 mm, or 70 mm, or 80 mm, or 90 mm. In an embodiment, the top portion diameter is 15 mm, or 20 mm, or 25 mm to 30 mm, or 35 mm, or 40 mm, or 45 mm, or 50 mm, or 60 mm, or 70 mm. In an embodiment, the wall thickness of the top portion of the fitment is 0.2 mm, or 0.3 mm, or 0.5 mm, or 0.75 mm to 1.0 mm, or 1.5 mm or 1.75 mm, or 2 mm.

The base 72 has a cross sectional shape. The cross sectional shape of the base 72 is selected from ellipse, circle, and regular polygon.

The outer surface of the base 72 may or may not include surface texture. In an embodiment, the outer surface of the base 72 has surface texture. Nonlimiting examples of surface texture include embossment, and a plurality of radial ridges to promote sealing to the inner surface of the neck wall 50.

In an embodiment, the outer surface of base 72 is smooth and does not include surface texture as shown in FIG. 7.

In an embodiment, the diameter of the base 72 is greater than the diameter of the top portion 74. FIG. 8 shows base 72 with circle cross-sectional shape and the diameter of base 72 is G having a length that is greater than the length of the diameter Q, the diameter of the top portion 74. Alternatively, in another embodiment the base 72 has a diameter equal to or less than the top portion 74 when the valve for the SBoV requires a larger top portion diameter.

The base 72 is welded, or is otherwise heat sealed to the multilayer film that forms the neck 30. In other words, the base 72 is welded to the neck 30. Heat sealing can be made by means of hot bar, impulse seal, ultrasonic or in some cases by high frequency (HF) sealing.

The fitment 70 is made from a polymeric material. Nonlimiting examples of suitable polymeric materials include propylene-based polymer, ethylene-based polymer such as high density polyethylene (HDPE), polyamides (such as Nylon 6, Nylon 6,6, Nylon 6,66, Nylon 6,12, Nylon 12 and the like.), cyclic olefin copolymers ("COC", such as TOPAS or APEL), polyesters (crystalline and amorphous), copolyester resin (such as "PETG"), cellulose esters (such as polylactic acid or "PLA"), and combinations thereof.

In an embodiment, the fitment 70 is made from an ethylene/α-olefin multi-block copolymer. Nonlimiting examples of suitable ethylene/α-olefin multi-block copolymer include polymers sold under the trade name INFUSE™ available from The Dow Chemical Company.

In an embodiment, the base 72 has a diameter (d) and a wall thickness (WT) as shown in FIG. 8. In FIG. 8, the diameter (d) is shown as distance G and the wall thickness (WT) is shown as the distance H. The diameter (d) can be uniform or can vary along the length of the base 72. Similarly, the wall thickness (WT) can be uniform or can vary along the length of the base 72.

In an embodiment, the diameter of the base 72 is uniform along the base length and the wall thickness (WT) is uniform along the base length.

In an embodiment, the base 72 has a diameter (d) from 5 mm, or 10 mm, or 12.5 mm, or 15 mm, or 18 mm, or 20 mm, or 23 mm, or 25 mm, or 27 mm, or 30 mm to 35 mm, or 38 mm, or 40 mm, or 45 mm, or 47 mm, or 50 mm, or 60 mm, or 70 mm, or 80 mm, or 90 mm, or 100 mm, or 110 mm, or 120 mm.

In an embodiment, the base 72 has a wall thickness (WT) from 0.15 mm, or 0.2 mm, or 0.3 mm, or 0.4 mm, or 0.5 mm, or 0.6 mm, or 0.7 mm, or 0.75 mm, or 0.8 mm, or 0.9 mm, or 1.0 mm to 1.3 mm, or 1.5 mm, or 1.7 mm, or 1.9 mm, or 2.0 mm.

In an embodiment, the base 72 has a wall thickness (WT) from 0.15 mm, or 0.2 mm, or 0.3 mm, or 0.4 mm to 0.5 mm, or 0.6 mm, or 0.7 mm, or 0.75 mm. As used herein, a base wall thickness with the foregoing wall thickness from 0.15 mm to 0.75 mm is a "thin-wall."

The base 72 has a diameter to wall thickness ratio. The "diameter to wall thickness ratio" (denoted as "d/WT") is the diameter (d) of the base 72 (in millimeters, mm) divided by the wall thickness (WT), in mm, of the base 72. In an embodiment, the base 72 has a d/WT from 5, or 8, or 10, or 12.5, or 15, or 20, or 30, or 40, or 50, or 60, or 70, or 80, or 90, or 100, or 125, or 150, or 175, or 200 to 300, or 350, or 400, or 450.

In an embodiment, the base 72 has a d/WT from 35, or 40, or 50, or 60, or 70, or 80, or 90, or 100, or 125, or 150, or 175 to 200, or 225, or 250, or 275 to 300, or 325, or 350, or 375, or 400, or 425, or 450.

In an embodiment, the base 72 has a d/WT ratio from 13 to 333, the diameter (d) is from 10 mm, or 12.5 mm, or 15 mm, or 18 mm, or 20 mm, or 23 mm, or 25 mm, or 27 mm, or 30 mm to 35 mm, or 38 mm, or 40 mm, or 45 mm, or 47 mm, or 50 mm and the wall thickness (WT) is from 0.15 mm, or 0.2 mm, or 0.3 mm, or 0.4 mm to 0.5 mm, or 0.6 mm, or 0.7 mm, or 0.75 mm. Thus, the base 72 has a thin-wall structure.

In an embodiment, the base 72 has a d/WT ratio from 20 to 267 as disclosed above. The diameter (d) for the base 72 is from 15 mm to 40 mm. The wall thickness (WT) for the base 72 is from 0.15 mm to 0.75 mm. Thus, the base 72 has a thin-wall structure.

In an embodiment, the base 72 has a d/WT ratio from 26 to 150 as disclosed aSBoVe. The diameter (d) for the base 72 is from 20 mm to 30 mm. The wall thickness (WT) for the base 72 is from 0.2 mm to 0.75 mm. Thus, the base 72 has a thin-wall structure.

The fitment with a d/WT from 35 to 450 can include a base with a thin-wall structure. Thin-wall fitments advantageously reduce production costs, reduce material cost, and reduce the weight of the final flexible container 10. The top portion 74 can have the same wall thickness (i.e., the same "thin wall" thickness) as the base 72.

3. Sleeve and Bag on Valve Assembly

The present device 4 includes a sleeve and bag-on-valve assembly (or "SBoV") 100, as shown in FIGS. 9-12. The SBoV 100 is attached to the top portion 74 of the fitment 70. The SBoV 100 includes a valve housing 102, a valve seat 104, a core tube 106, a bag 108, and a sleeve 110.

Figure 11:
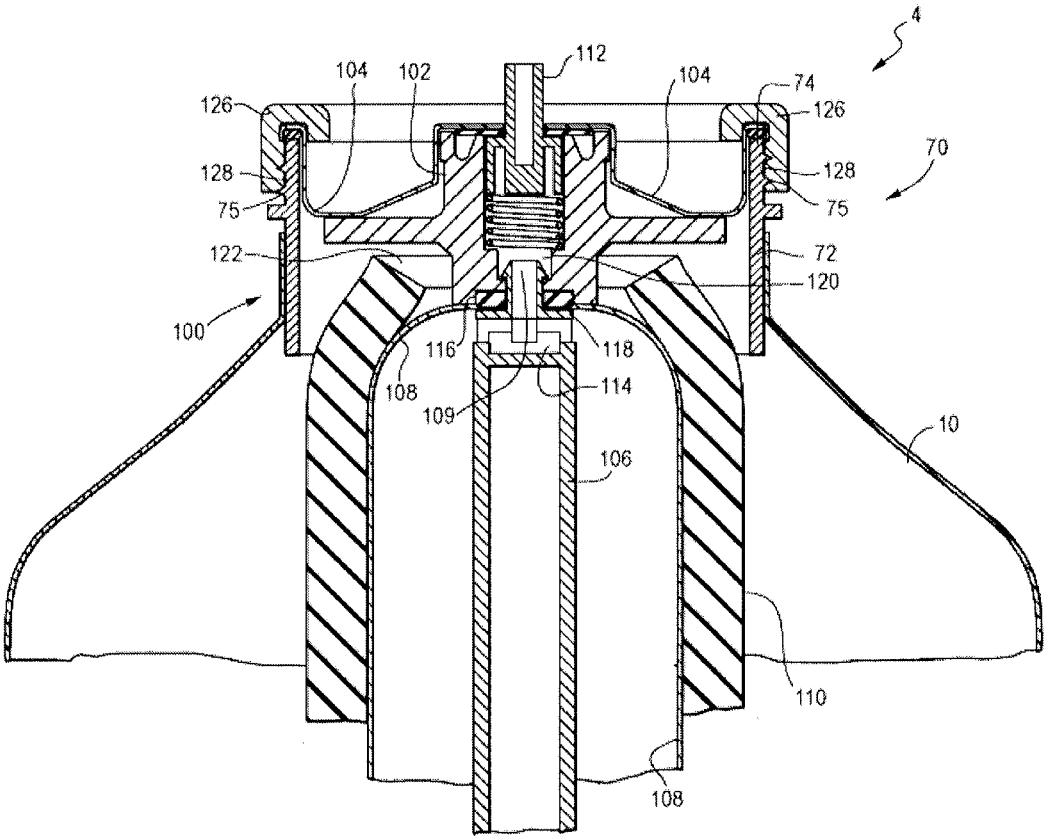
FIG. 11 is an enlarged view of area 11 of FIG. 10.

The valve housing 102 is configured to hold a valve 112, as shown FIG. 11. FIG. 11 shows a nonlimiting example of a spring valve. The valve housing 102 is securely attached to the valve seat 104. Secure attachment between the valve housing 102 and the valve seat 104 can occur by way of (i) crimping the valve seat 104 onto the valve housing 102, adhesive attachment between the valve housing 102 and the valve seat 104, and (iii) a combination of (i) and (ii).

Figure 10:
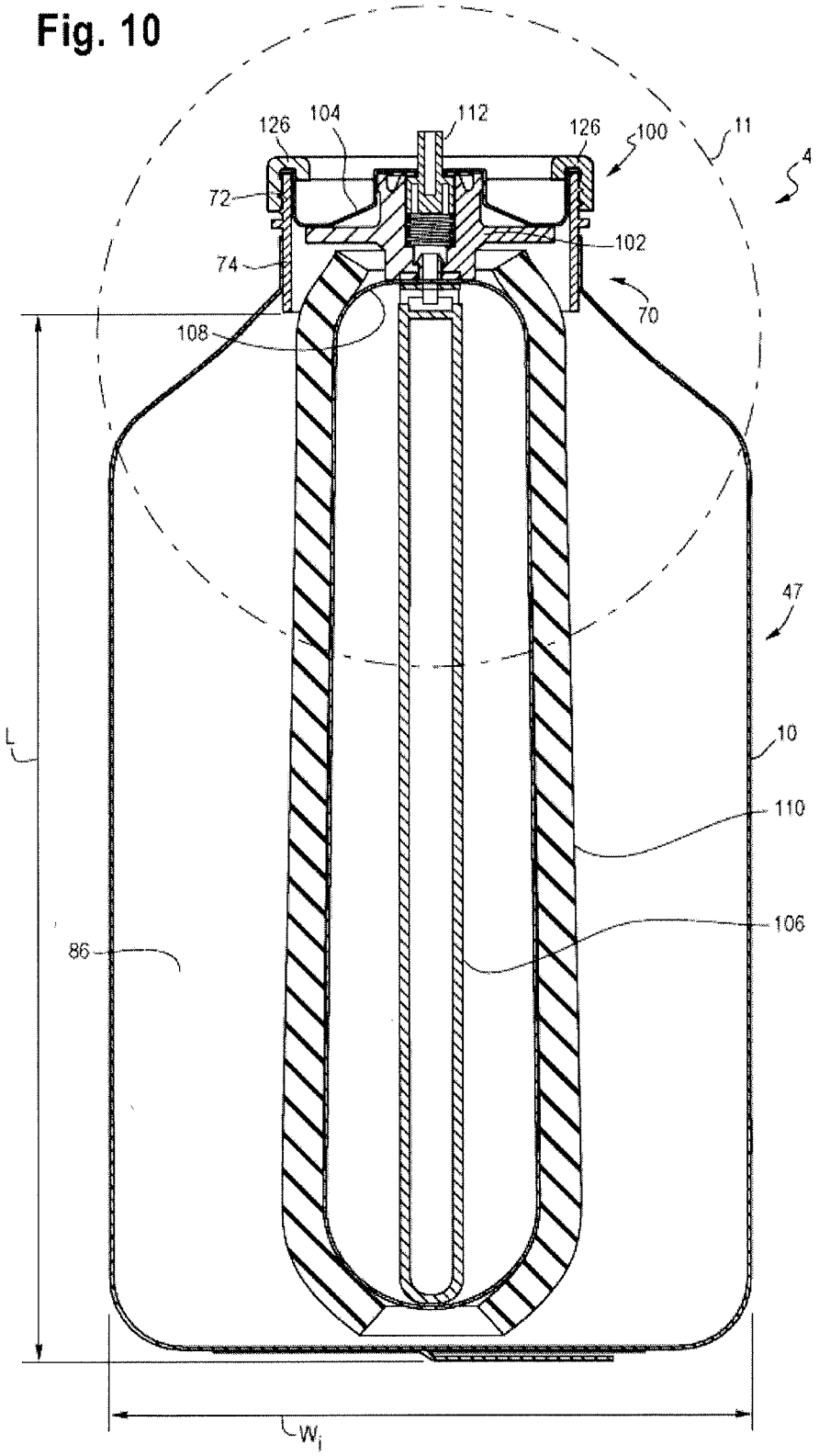
FIG. 10 is a sectional view of the device taken along line 10-10 of FIG. 9.

As shown in FIG. 10, the core tube 106 is present in the interior of the bag 108, with the bag 108 surrounding the core tube 108. The bag 108 is a flexible film structure composed of a polymeric material. The bag 108 can be a single layer flexible film or a multilayer flexible film. Nonlimiting examples of suitable polymeric material for the bag 108 includes propylene-based polymer, ethylene-based polymer, and combinations thereof.

In an embodiment, the bag 108 is a multilayer film having a thickness from 100 μm, or 200 μm to 225 μm, or 250 μm and the multilayer film is chemically resistant and a barrier to the fluid composition it contains. In a further embodiment the bag 108 is a multilayer film and includes an oxygen barrier layer, a carbon dioxide barrier layer, a water barrier layer, and combinations thereof.

In an embodiment, the flexible container 10 is a large volume flexible container and the volume of the bag 108 is from 5%, or 10%, or 15% to 20%, or 25%, or 30% less than the volume of the large volume flexible container.

In an embodiment, the flexible container 10 is a large volume flexible container and the bag 108 has an expanded volume from 0.5 L, or 0.75 L, or 1.0 L, or 1.5 L, or 2.5 L, or 3.0 L, or 3.5 L, or 4.0 L, or 5.0 L, or 10.0 L to 20.0 L, or 25 L, or 28.5 L.

The core tube 106 can be hollow or can be solid. The core tube 106 can be fluted, pleated or channeled axially to promote movement of product into and through the port 114.

The core tube 106 can be composed of propylene-based polymer or ethylene-based polymer such as HDPE. Alternatively, the core tube 106 can be composed of an amorphous polyester such as PETG or other suitable engineering thermoplastic.

In an embodiment, the core tube 106 is composed of a non-crushable material.

The core tube 106 can have a uniform diameter along its length. Alternatively, the core tube 106 can be tapered. In an embodiment, the core tube 106 is tapered and the diameter of the core tube 106 gradually increases, moving from the proximate end (or top end) of the core tube to the distal end of the core tube. The distal end of the core tube is rounded to reduce- or prevent-puncture of the bag 108 if the device 4 is dropped.

The core tube 106 can be integral to, or can be a separate component attached to, the valve housing 102. In an embodiment, the core tube 106 is a component separate from the valve housing 102 and the core tube 106 is hollow. A hollow top end 109 of the core tube 106 extends through the opening of the bag 108 as shown in FIG. 11. The core tube 106 includes a port 114 and a port head 118. The port 114 is below the hollow top end 109 and in fluid communication with the hollow top end 109. The open end of the bag 108 is placed between a gasket 116 and the port head 118. The hollow top end 109 attaches to a valve channel 120 on the underside of the valve housing 102 to place the port 114 in fluid communication with the valve 112. The gasket 116 sandwiches the bag opening between the port head 118 and the valve housing 102 to hermetically close, or otherwise securely seal, the bag 108 to the valve housing 102.

In a further embodiment, the secure attachment between the top end 109 and the valve channel 120 is by way of a fixed and secure snap fit. Materials of construction for the top end 109 can be different than for the core tube 106. For example, INFUSE' ethylene/alpha-olefin multi-block copolymer may be used. Also, in an embodiment, the bag 108 can be heat sealed to the top end 109 to provide hermetic seal and then secured into the valve channel 120.

The sleeve 110 is a tube-like structure made of an elastomeric material. An "elastomeric material," as used herein, is a material that can be stretched with the application of stress to at least twice its length and after release of the stress, returns to its approximate original dimensions and shape showing good recovery. The elastomeric material may, or may not, be a vulcanized or cross-linked or grafted material.

In an embodiment, the elastomeric material is vulcanized.

In an embodiment, the elastomeric material has a linear modulus vs elongation relationship. The elastomeric material exhibits a small amount of creep or stress relaxation sufficient to provide a shelf life from 3 months, or six months to 1 year for the fluid composition.

Nonlimiting examples of suitable elastomeric material include ethylene copolymers (like ENGAGE™), ethylene olefin block copolymers (like INFUSE™), ethylene propylene diene monomer terpolymer (EPDM such as NORDEL™ EPDM polymers), ethylene propylene (EPM), nitrile rubber, hydrogenated nitrile butadiene rubber (HNBR), polyacrylic rubber, silicone rubber, fluorosilicone rubber, fluoroelastomers, perfluoro rubber, natural rubber (i.e., natural polyisoprene), synthetic polyisoprene, chloropene, polychloroprene, neoprene, halogenated or non-halogenated butyl rubber (copolymer of isobutylene and isoprene), styrene-butadiene rubber, epichlorohydrin, polyether block amides, chlorosulfonated polyethylene, and any combination of the foregoing. Elastomer additives known in the art to be provide benefit such as antioxidant and processing stabilizers, antiblocks, vulcanization agents (typically sulfur), crosslink agents such as peroxides, accelerators, activators, and optionally dispersants, processing aids, plasticizers, and fillers including organoclays and nanoclays, carbon black, etc. can be included in the elastomer composition.

In an embodiment, the elastomeric material comprises nano-sized organoclays or nanoclays and as such in an elastomeric composite or elastomeric nanocomposite, for example.

The sleeve can expand (and contract), or otherwise elongate, in a radial direction and an axial direction.

In an embodiment, the sleeve expands and contracts in the radial direction.

The sleeve 110 is sized and shaped to contain the bag 108 and to exert pressure on bag 108 when the bag 108 is filled with fluid composition (or fluid product) to be dispensed. The sleeve 110 may or may not have a uniform thickness. The sleeve 110 may or may not impart uniform pressure during the discharge cycle of fluid composition from the bag 108.

In an embodiment, the sleeve 110 provides even pressure during the entire dispensing cycle (bag filled with fluid composition to bag emptied of fluid composition). The sleeve 110 also provides positive pressure on the bag after dispensing ensuring complete discharge of all, or substantially all, fluid composition from the bag 108. The sleeve 110 may or may not be open on top and bottom. The elastic sleeve 110 may be longer than the bag 104 to ensure emptying of all the contents in bag 108.

The sleeve 110 is thick enough to apply a force that is sufficient to expel product from the bag 108 and through the valve 112. When the valve 112 is actuated, the sleeve 110 uniformly contracts to push fluid composition from the bag 108, through the port 114 and out through the valve 112. In an embodiment, the sleeve 110 has a thickness when unexpanded, or otherwise unstretched, and denoted as "sleeve wall thickness." The sleeve wall thickness is from about 1.5 mm, or 2.0 mm, or 3.0 mm or 5.0 mm, or 7.0 mm to 10.0 mm, or 15.0 mm, or 20.0 mm.

In an embodiment, the sleeve 110 is made of an elastomeric material that has an elongation from greater than 200%, or 250%, or 300% to 400%, or 500%, or 550%, or 600%, or 700%.

In an embodiment, the elastomeric material has a tensile modulus at 200% elongation of at least 2 MPa, or 3 MPa, or 5 Mpa to 8 Mpa, or 10 Mpa, or 12 Mpa, or 14 MPa or higher.

In an embodiment, the sleeve 110 is extended (stretched) to from 300% elongation, or 400% elongation to 500% elongation. In an embodiment, the elastomeric material can have a modulus that is 20 MPa or higher at 400% elongation. The sleeve 110 may also exhibit a relaxation lower than 25% change in tensile modulus at 200% elongation within one year and/or an average creep rate lower than 4 mm/day.

In an embodiment, a clip 122 secures the sleeve 110 to the valve housing 102 as shown in FIG. 11.

In an embodiment, the minimum diameter of the core tube 106 encircled by the empty bag 108 combined (BoV) is greater than the diameter of the unstretched sleeve 110. With this configuration, the sleeve 110 provides constant positive pressure onto the bag 108 ensuring uniform distribution of the product from the bag until full and complete expulsion of all, or substantially all, product from the bag 108.

In an embodiment, the core tube 106 and empty bag 108 (the BoV) have a combined minimum diameter that is from 10%, or 15%, or 20% to 25%, or 30%, or 40%, or even 50% greater than the diameter of the unexpanded sleeve 110. In this way, the sleeve 110 applies constant positive pressure upon the bag 108.

In an embodiment, the sleeve is longer than the bag on core/valve to ensure positive pressure is exerted on the bottom end of the bag sufficient to expel product at the bottom of the bag up and through the port 114 and through the valve 112.

4. SBoV Attached to Fitment

The present device 4 includes the sleeve and bag on valve (SBoV) assembly 100 attached to the fitment 70. In an embodiment, the bag 108 is wrapped around the core tube 106 and contained in the sleeve 110, and the bag is empty. The aggregate diameter of the core tube 106, the bag 108 (empty), and the sleeve 110 is the SBoV outer diameter, or "SBoV-OD." SBoV-OD is less than the inner diameter of the fitment 70 ("fitment ID") such that the core tube/bag/sleeve portion of the SBoV can be inserted through the fitment 70 and into the interior of the flexible container 10. In this way, the core tube/bag/sleeve is inserted into the fitment 70, first through the top portion 74 and then through the base 72.

In an embodiment, the valve seat 104 includes arm portion 124 for engaging the top surface of the fitment top portion 72 as shown in FIG. 11. A retaining ring 126 threadedly engages the threads of the fitment 70, sandwiching the arm portion 124 between the fitment top portion 72 and the interior of the retaining ring 126. Suitable gasketing can be installed above and/or below the arm portion 124 to ensure a hermetic seal between the fitment 70, the valve seat 104, and the retaining ring 126.

The retaining ring 126 is annular in shape. Downward rotation of the retaining ring 126 onto the fitment 70, engages the fitment threads 75 with retaining ring threads 128. The threaded engagement between fitment threads 75 and retaining ring threads 128 impinges the retaining ring against the valve seat 104 as shown in FIG. 11. The valve seat 104 becomes firmly sandwiched between the retaining ring 126 and the fitment 70. In other words, the valve seat 104 is sandwiched within the threaded engagement (threads 75, 128) between the fitment 70 and the retaining ring 126. The retaining ring 126 thereby forms a seal between the fitment 70 and the valve seat 104. In this way, the retaining ring 126 attaches, or otherwise secures, the fitment 70 to the valve seat 104.

In an embodiment, the retaining ring 126 is made from a polyolefin such as HDPE.

In an embodiment, one or more gaskets are located, or otherwise are disposed, between the retaining ring 126 and the fitment 70. The gasket(s) can be (i) located between the retaining ring 126 and the valve seat 104, (ii) located between the valve seat 104 and the fitment 70, and (iii) located at both (i) and (ii). The gasket(s) is(are) composed of a resilient material that closes any gaps in the mated engagement between the retaining ring 126 and the fitment 70. In a further embodiment, the gasket(s) form(s) a hermetic seal between the retaining ring 126, the valve seat 104, and the fitment 70.

In an embodiment, neither the fitment 70 nor the retaining ring 126 has threads. Attachment occurs by way of snap-on fit (alone or in combination with an adhesive material) of the retaining ring over the valve seat 104 and onto the fitment 70. The snap-on engagement between the fitment 70 and the retaining ring firmly sandwiches the valve seat 104 between the retaining ring 126 and the fitment 70 to produce a hermetic seal. The snap-on engagement between the fitment 70 and the retaining ring 126 can include one or more gaskets as previously discussed.

Figure 12:
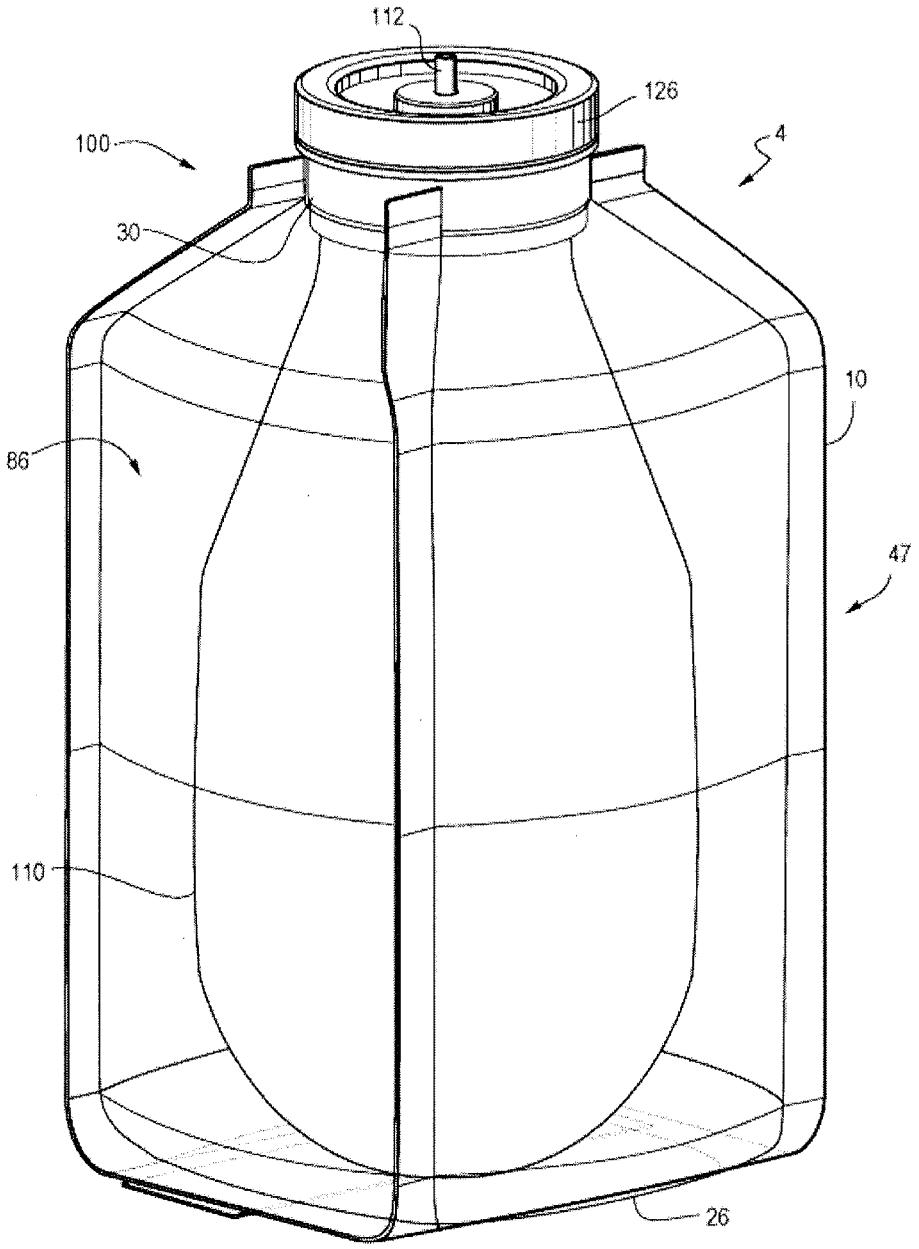
FIG. 12 is a perspective view of the device of FIG. 9 with the SBoV filled with product in accordance with an embodiment of the present disclosure.

FIG. 12 demonstrates the SBoV 100 after the bag 108 has been filled with a fluid composition. FIG. 12 shows sleeve 110 stretched with the bag 108 holding a fluid composition and sleeve 110 applying the pressure. It is understood that the SBoV 100 is first inserted through the fitment 70 and into the body 47 interior prior to loading the fluid composition into the bag 108.

The fluid composition (for dispensing from the bag 108) is a substance that is fluidly deliverable when dispensed under compressive pressure by the sleeve 110, the fluid composition flowing out of the bag 108 under pressure when the valve 112 is opened. The fluid composition can be a liquid, a paste, a foam, a powder, or any combination thereof. Nonlimiting examples of suitable fluid compositions include:

- food products, such as mayonnaise, ketchup, mustard, sauces, desserts (whipped cream), spreads, oil, pastry components toothpaste, grease, butter, margarine, sauces, baby food, salad dressing, condiments, beverages, syrup;
- personal care products such as cosmetics creams, lotions, skin care products, hair gels, personal care gel, liquid soap, liquid shampoo, sun care products, shaving cream, deodorant;
- medicaments, pharmaceutical and medical products such as medications (including dosage packages) and ointments, oral and nasal sprays;
- household products such as polishes and glass, bathroom and furniture and other cleaners, insecticides, air fresheners; and
- industrial products such as paints, lacquers, glues, grease and other lubricants, oil sealants, pastes, chemicals, insecticides, herbicides, and fire extinguishing components.

In an embodiment, the present flexible container 10 maintains its shape, not collapsing or changing dimensions or appearance as the fluid composition is expelled from the bag (creating internal vacuum) unless desired as a way to indicate amount of product remaining.

FIG. 12 shows the device 4 with a large volume flexible container 10 and from 1.0 L, or greater than 1.0 L to 28.5 L fluid composition present in the bag 108. As shown in FIG. 12, the bottom segment 26 of the body 47 rests on a support surface and supports the bottom of the filled bag 108. The panels of the body 47 and the neck 30 provide sufficient strength and rigidity to maintain, or otherwise hold, the filled bag 108 in a vertical position, or in a substantially vertical position. The large volume flexible container 10 holds filled bag 108 in an upright position. Therefore, in an embodiment, the device 4 with large volume flexible container 10 and SBoV 100 is a "large volume stand-up container" (sometimes referred to as a stand-up pouch or "SUP").

The body 47 defines a body interior (or interior) 86 for the large volume flexible container 10. In an embodiment, the large volume flexible container 10 is hermetically sealed and the interior 86 is filled with a pressurized gas (air, nitrogen, carbon dioxide) before the bag 108 is filled with the fluid composition. The pressurized gas is at a pressure from 1 atmosphere (atm) to 2 atm. The pressurized gas helps the flexible container 10 maintain a stand-up shape during the entire delivery cycle of the SBoV (from full bag to complete, or substantially complete, emptying of fluid composition from the bag).

In an embodiment, a hermetically sealed large volume flexible container 10 serves as a secondary containment system should the bag 108 of the SBoV 100 fail and leak out.

In an embodiment, the large volume flexible container 10 is hermetically sealed with 0.1 to 0.9 atm pressure (vacuum) before filling the bag 108 with the fluid composition 104 with product. This configuration allows collapse of flexible container 10 as the fluid composition is evacuated during product use and visually indicates remaining product. In such a case the body 47 can be hung upside down in use, as stand-up capability will likely be lost as fluid composition is evacuated. For example, the device 4 could be used as a backpack to deliver product in the field.

In an embodiment, the present large volume flexible container 10 provides sufficient support such that the large volume flexible container does not move when the valve 112 is actuated and fluid composition is expelled through the valve. In another embodiment, this support for the container 10 is supplied by the fitment having a wall thickness greater than the container film panels. It is envisioned that a person can grasp the neck or fitment between thumb and middle finger and then activate the value for the product delivery, for example, by pressing a spray cap with the index finger of the same hand. It is also envisioned, that the fitment can have a machine grabbing support ridge between base 72 and top portion 74 such as shown in FIG. 7 in order to aid in the filling and handling of the flexible containers using automatic equipment.

In an embodiment, the present large volume flexible container 10 includes at least one handle for securing the device during filling of the bag. The handle provides the ability to grab and hold the device. In this way, the present device with large volume flexible container and attached SBoV can be filled with conventional aerosol-type filling systems.

In an embodiment, the device with large volume flexible container and attached SBoV can be refilled one time to a large number of times. After complete, or substantially complete discharge of the fluid composition, the bag 108 can be re-filled with fluid composition through the valve 112.

The present device 4 enables the load of fluid composition without creating an odd-shaped or distorted container. The present large volume flexible container loads evenly about the longitudinal axis of the bag such that the final shape of the filled bag resembles a uniform, or substantially uniform, cylinder.

delivery of the fluid composition using the hose as an extension of the valve while wearing the device as a backpack, for example.

In an embodiment, the flexible container 10 is composed of all, or substantially all, ethylene-based polymer, alone or in combination with, propylene-based polymer.

5. Length to Width Ratio

In an embodiment, the large volume flexible container 10, when expanded, has a length (L) and a width (Wi) as shown in FIG. 10. The large volume flexible container 10 has a L:Wi ratio from 1.0, or 1.5, or 2.0, or 2.5 to 3.0, or 3.5, or 4.0, or 4.5, or 5.0.

In an embodiment, the device 4 has a L:Wi ratio from 1.0, or 1.5, or 2.0 to 2.5, or 3.0.

In an embodiment, the device 4 includes large volume flexible container 10 having a volume from 1.0 L to 30.0 L, a L:Wi ratio from 1.0 to 3.0, the bag 108 has an expanded volume from 0.75 L to 28.5 L, a fitment ID from 24 mm to 120 mm. The large volume container has a design that is drop resistant from shelf heights and allows stand-up and stacking efficiency on store shelves.

In an embodiment, the device 4 has a L:Wi ratio of 1.0. The large volume flexible container volume is from 1.0 L to 30.0 L. The fitment inner diameter ("fitment ID") is greater than the SBoV-OD. The SBoV-OD is from 10.0 mm to 45.0 mm. The fitment ID is from 20.0 mm to 90.0 mm. The sleeve wall thickness (unstretched) is from 4.5 mm to 18.8 mm. The sleeve is expanded to 400% elongation when the device is filled with fluid composition. The diameter of the 400% expanded sleeve is from 75 mm to 320 mm. A device with these features is denoted as "a L:Wi 1.0 device."

Nonlimiting examples of suitable L:Wi 1.0 devices are provided in Table 1 below.

TABLE 1

| Flexible container volume, liter | Product volume in SBoV, liter | L/Wi | Sleeve $OD_2$, mm (400% expansion) | Sleeve $OD_1$, mm (25% expansion) (equals SBoV OD) | Sleeve wall $t_0$ unstretched, mm | Core tube + bag OD, mm | Fitment ID, mm |
|---|---|---|---|---|---|---|---|
| 0.5* | 0.38 | 1.0 | 79.4 | 19.8 | 4.8 | 11.1 | 21.8 |
| 1.0 | 0.75 | 1.0 | 100.0 | 25.0 | 6.1 | 14.0 | 27.5 |
| 3.9 | 2.91 | 1.0 | 157.1 | 39.3 | 9.5 | 22.0 | 43.2 |
| 5.0 | 3.75 | 1.0 | 171.0 | 42.8 | 10.3 | 23.9 | 47.0 |
| 10.0 | 7.50 | 1.0 | 215.4 | 53.9 | 13.0 | 30.2 | 59.2 |
| 15.0 | 11.25 | 1.0 | 246.6 | 61.7 | 14.9 | 34.5 | 67.8 |
| 20.0 | 15.00 | 1.0 | 271.4 | 67.9 | 16.4 | 38.0 | 74.6 |
| 30.0 | 22.50 | 1.0 | 310.7 | 77.7 | 18.8 | 43.5 | 85.4 |

*Not large volume flexible container, all others = large volume flexible container $OD_2$ = sleeve outer diameter when stretched to 400% elongation $OD_1$ = aggregate diameter when sleeve is stretched over core tube and bag to 25% elongation (i.e., SBoV outer diameter)

$t_o$ = sleeve wall thickness when sleeve un-stretched

As shown in FIG. 12, the fill bag 108 has a shape and volume that is similar to the shape and volume of the expanded flexible container 10.

The valve 112 can also have various types of actuators or spray caps fastened to it in order to deliver product in the desired manner including but not limited to fluid stream, gel, lotion, cream, foam, fluid spray, or mist.

In an embodiment, the device 4 includes a hose with a delivery valve attached to the valve 112 leaving the valve in open mode. The hose with delivery valve enables spray In an embodiment, the device has a L:Wi ratio of 2.0. The flexible container volume is from 1.0 L to 30.0 L. The fitment ID is greater than the SBoV outer diameter. SBoV-OD is from 8.0 mm to 35.0 mm. The fitment ID is from 17.0 mm to 70.0 mm. The sleeve wall thickness (unstretched) is from 3.5 mm to 16.0 mm. The sleeve is expanded to 400% elongation when the device is filled with fluid composition. The diameter of the 400% expanded sleeve is from 60 mm to 250 mm. A device with these features is denoted as "a L:Wi 2.0 device."

Nonlimiting examples of suitable L:Wi 2.0 devices are provided in Table 2 below.

TABLE 2

| Flexible container volume, liter | Product volume in SBoV, liter | L/Wi | Sleeve $OD_2$, mm (400% expansion) | Sleeve $OD_1$, mm (25% expansion) (equals SBoV OD) | Sleeve wall $t_0$ unstretched, mm | Core tube + bag OD, mm | Fitment ID, mm |
|---|---|---|---|---|---|---|---|
| 0.5* | 0.38 | 2.0 | 63.0 | 15.7 | 3.8 | 8.8 | 17.3 |
| 1.0 | 0.75 | 2.0 | 79.4 | 19.8 | 4.8 | 11.1 | 21.8 |
| 3.9 | 2.91 | 2.0 | 124.7 | 31.2 | 7.5 | 17.5 | 34.3 |
| 5.0 | 3.75 | 2.0 | 135.7 | 33.9 | 8.2 | 19.0 | 37.3 |
| 10.0 | 7.50 | 2.0 | 171.0 | 42.8 | 10.3 | 23.9 | 47.0 |
| 15.0 | 11.25 | 2.0 | 195.7 | 48.9 | 11.8 | 27.4 | 53.8 |
| 20.0 | 15.00 | 2.0 | 215.4 | 53.9 | 13.0 | 30.2 | 59.2 |
| 30.0 | 22.50 | 2.0 | 246.6 | 61.7 | 14.9 | 34.5 | 67.8 |

*Not large volume flexible container, all others = large volume flexible container
$OD_2$ = sleeve outer diameter when stretched to 400% elongation
$OD_1$ = aggregate diameter when sleeve is stretched over core tube and bag to 25% elongation (i.e., SBoV outer diameter)
$t_o$ = sleeve wall thickness when sleeve un-stretched In an embodiment, the device has a L:Wi ratio of 3.0. The flexible container volume is from 0.5 L to 30.0 L. The fitment ID is greater than the SBoV outer diameter. The SBoV-OD is from 7.0 mm to 31.0 m. The fitment ID is from 14.0 mm to 60.0 mm. The sleeve wall thickness (un-stretched) is from 3.0 mm to 14.0 mm. The sleeve is expanded to 400% elongation when the device is filled with product. The diameter of the 400% expanded sleeve is from 54 mm to 220 mm. A device with these features is denoted as "a L:Wi 3.0 device."

Nonlimiting examples of suitable L:Wi 3.0 devices are provided in Table 3 below.

TABLE 3

| Flexible container volume, liter | Product volume in SBoV, liter | L./Wi | Sleeve $OD_2$, mm (400% expansion) | Sleeve $OD_1$, mm (25% expansion) (equals SBoV OD) | Sleeve wall $t_0$ unstretched, mm | Core tube + bag OD, mm | Fitment ID, mm |
|---|---|---|---|---|---|---|---|
| 0.5* | 0.38 | 3.0 | 55.0 | 13.8 | 3.3 | 7.7 | 15.1 |
| 1.0 | 0.75 | 3.0 | 69.3 | 17.3 | 4.2 | 9.7 | 19.1 |
| 3.9 | 2.91 | 3.0 | 108.9 | 27.2 | 6.6 | 15.2 | 29.9 |
| 5.0 | 3.75 | 3.0 | 118.6 | 29.6 | 7.2 | 16.6 | 32.6 |
| 10.0 | 7.50 | 3.0 | 149.4 | 37.3 | 9.0 | 20.9 | 41.1 |
| 15.0 | 11.25 | 3.0 | 171.0 | 42.8 | 10.3 | 23.9 | 47.0 |
| 20.0 | 15.00 | 3.0 | 188.2 | 47.1 | 11.4 | 26.3 | 51.8 |
| 30.0 | 22.50 | 3.0 | 215.4 | 53.9 | 13.0 | 30.2 | 59.2 |

*Not large volume flexible container, all others = large volume flexible container
$OD_2$ = sleeve outer diameter when stretched to 400% elongation
$OD_1$ = aggregate diameter when sleeve is stretched over core tube and bag to 25% elongation (i.e., SBoV outer diameter)
$t_o$ = sleeve wall thickness when sleeve un-stretched The SBoV has a cylindrical shape (and circular footprint) inside the container. Regardless of L:Wi ratio, the SBoV can be filled with fluid composition from 70%, or 75%, or 80% to 85%, or 90%, or 95%, the volume of the expanded flexible container 10. When the flexible container 10 has a rectilinear shape having flat panel walls with a square footprint. However, the SBoV can be filled with fluid composition up to 95% of the expanded flexible container 10 volume when the flexible container 10 has a cylindrical shape (circular footprint) that matches, or is similar in shape, with the SBoV inside bag and sleeve.

An advantage of the flexible container 10 is the ability to increase container efficiency by loading a greater amount of fluid composition into the SBoV relative to the flexible container size. The flexible container sidewalls can easily move to accommodate the increase in volume from 70% usage of the flexible container (rectilinear shape) up to 95% usage (cylindrical shape). Tables 1-3 represent data for a rectilinear flexible container. For example, a cylindrical-shaped flexible container 10 can replace the 20 L rectilinear flexible container in Tables 1-3 and then when 15 L of the product is loaded into the SBoV it would fill the flexible container 10 into a cylindrical shape.

Also, the bag 108 can have a design similar to the design for the flexible container 10 in order to increase in capacity which is especially useful and more stable for large volume flexible containers.

In an embodiment, the bag 108 can be a pillow pouch design as commonly sold for BoV for rigid containers.

DEFINITIONS AND TEST METHODS

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

The term "creep" or "creep rate" is a relaxation characteristic of an elastomeric material. As used herein, "creep" represents the time dependent change in strain while maintaining a constant stress.

Density is measured in accordance with ASTM D 792.

The phrase "elastomeric composite" encompasses also elastomeric nanocomposites, nanocomposites, and nanocomposite compositions. The term "nanofiller" is used in the art collectively to describe nanopartic!es useful for making nanocomposites. Such particles can comprise layers or platelet particles (platelets) obtained from particles comprising layers and can be in a stacked, intercalated, or exfoliated state. In some cases, the nanofillers comprise particles of a clay material known in the art as nanoclays (or NCs).

Elongation is determined in accordance with ASTM D 412. Elongation is the extension of a uniform section of a specimen (i.e., an elastomeric composite) expressed as percent of the original length as follows:

$$\text{Elongation } \% = \frac{\text{Final length} - \text{Original length}}{\text{Original length}} \times 100$$

An "ethylene-based polymer," as used herein is a polymer that contains more than 50 mole percent polymerized ethylene monomer (based on the total amount of polymerizable monomers) and, optionally, may contain at least one comonomer.

The term "heat seal initiation temperature," is minimum sealing temperature required to form a seal of significant strength, in this case, 2 lb/in (8.8N/25.4 mm). The seal is performed in a Topwave HT tester with 0.5 seconds dwell time at 2.7 bar (40 psi) seal bar pressure. The sealed specimen is tested in an Instron Tensioner at 10 in/min (4.2 mm/sec or 250 mm/min).

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

As used herein, the term "stress relaxation", which is also used herein simply as "relaxation", describes time dependent change in stress while maintaining a constant strain. Stress of strained elastomeric material decreases with time due to molecular relaxation processes that take place within the elastomer.

Tensile strength and modulus, —"Tensile strength" is a measure of the stiffness of an elastic material, defined as the linear slope of a stress-versus-strain curve in uniaxial tension at low strains in which Hooke's Law is valid. The value represents the maximum tensile stress, in MPa, applied during stretching of an elastomeric composite before its rupture. "Modulus" is a tensile stress of an elastomeric material at a given elongation, namely, the stress required to stretch a uniform section of an elastomeric material to a given elongation. This value represents the functional strength of the composite. M100 is the tensile stress at 100% elongation, M200 is the tensile stress at 200% elongation, etc. Tensile strength and modulus are measured in accordance with ASTM D 412.

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

Some embodiments of the present disclosure will now be described in detail in the following examples.

EXAMPLES

1. Materials

A. Flexible Container

Flexible containers are made using flexible film A or flexible film B. Each of flexible film A and flexible film B is a seven layer co-extruded flexible multilayer film with composition and structure provided in Table 4 below. Flexible film A has a thickness of 100 micrometer (μm) and flexible film B has a thickness of 250 μm. Both films may be obtained from ISO Poly Films (Gray Court, S.C.).

TABLE 4

Composition of flexible multilayer film for flexible container panels (7 layer co-extruded flexible multilayer film)

| Overall | Description | % Thickness | Weight % | Layer | Density |
|---|---|---|---|---|---|
| ULTRAMID C33L01 | Nylon 6/66 viscosity number 195 $cm^3/g$ (ISO 307 @ 0.5% in 96% $H_2SO_4$), melting point 196° C. (ISO 3146) | 13.0% | 15.3% | 1 | 1.12 |
| AMPLIFY TY1352 | Maleic anhydride grafted polyethylene 0.922 $g/cm^3$; 1.0 MI @ 2.16 Kg 190° C. | 12.0% | 11.6% | 2 | 0.922 |
| ELITE 5400G | Polyethylene density 0.916 $g/cm^3$; 1.0 MI @ 2.16 Kg 190° C. | 20.0% | 19.2% | 3 | 0.916 |
| AMPLIFY TY1352 | Maleic anhydride grafted polyethylene 0.922 $g/cm^3$; 1.0 MI @ 2.16 Kg 190° C. | 12.0% | 11.6% | 4 | 0.922 |
| ULTRAMID C33L01 | Nylon 6/66 viscosity number 195 $cm^3/g$ (ISO 307 @0.5% in 96% $H_2SO_4$), melting point 196° C. (ISO 3146) | 6.0% | 7.0% | 5 | 1.12 |
| AMPLIFY TY1352 | Maleic anhydride grafted polyethylene 0.922 $g/cm^3$; 1.0 MI @ 2.16 Kg 190° C. | 12.0% | 11.6% | 6 | 0.922 |
| AFFINITY PF1146G | Ethylene alpha-olefin copolymer 0.899 $g/cm^3$; 1.0 MI @ 2.16 Kg 190° C. | 23.6% | 22.3% | 7* | 0.899 |
| AMPACET 10090 (S) | Slip masterbatch available from Ampacet Corp. | 1.0% | 1.0% | 7* | 0.92 |
| AMPACET 10063 (AB) | Antiblock masterbatch available from Ampacet Corp. | 0.4% | 0.4% | 7* | 1.05 |
| Total | | 100.0% | 100.0% | | |

*layer 7 is a 3-component blend, layer 7 is the heat seal layer (or seal layer)

2. Sleeve

The sleeve for the SBoV is composed of a vulcanized (sulfur 2 phr) elastomeric composite containing natural rubber (90 phr), polybutadiene rubber (10 phr), carbon black (40 phr), nanoclay (13 phr) as primary components, along with additives—zinc oxide (5 phr), stearic acid (2 phr), accelerators (1-2 phr), and retarder (1 phr) (hereafter elastomer composite A). The sleeve provides a tensile modulus of at least 20 MPa when at 400% elongation. The sleeve has a relaxation lower than 15% change in tensile modulus at 200% elongation within one year and/or an average creep rate lower than 2 mm/day. The sleeve, when expanded from 200% to 400% elongation, is capable of imparting up to 8 bar pressure onto the bag.

Example 1

0.5 L

A valve housing having a spring valve is crimped to an approximately 20 mm outer diameter valve seat. A rigid core tube (HDPE, 1.5 mm wall), hollow but closed, of approximately 7.5 mm outer diameter×125 mm length having a round end and port at the top is inserted into a pouch bag (prepared with 112 μm thick adhesively laminated film commonly used in BoV consisting of Polyester 12 μm//Aluminum 9 μm//Nylon 15 μm//Polyethylene 76 μm) with bag opening tight around the core tube and attached to a valve insert that is snap fit into a valve housing thereby hermetically sealing the bag to the valve housing via a gasket (alternatively the bag can be heat sealed to the valve insert). The bag is wound around the core tube to create a BoV assembly having an approximately 9 mm outer diameter. An elastic sleeve of approximately 12.5 mm outer diameter, 3.8 mm wall thickness (un-stretched) and 150 mm length made of elastomeric composite A is stretched to insert the BoV assembly and the BoV is inserted into the elastic sleeve to create the SBoV. The SBoV is inserted through a standard fitment of 20 mm outer diameter on a flexible container of 0.5 liter volume having a L/D=2:1, outer diameter sidewall of approximately 63 mm, and made of flexible film A. A 20 mm retaining ring is tightened onto the fitment screw threads to secure the valve seat/SBoV assembly. The 25% pre-expansion of the sleeve over the BoV creates a positive pressure of approximately 0.3 bar when empty. Fluid composition can then be loaded through the valve into the bag and the sleeve is expanded to the outer wall of the flexible container representing a 400% expansion and creating a pressure of approximately 8 bar. An actuator can be then added to the valve to deliver the desired stream/spray for the application. As fluid composition exits the container both the bag and the flexible container collapse.

Example 2

10 L

A valve housing having a spring valve is crimped to an approximately 48 mm outer diameter valve seat. A rigid core tube (HDPE, 3 mm wall), hollow but closed, of approximately 20 mm outer diameter×340 mm length having a round end and an exit hole at the top is inserted into a pouch bag made with a 250 μm coextruded polyethylene film consisting of ELITET™ 5400G enhanced polyethylene and 50 μm AFFINITY™ PF1146G sealant with opening tight around the tube and attached to a valve insert that is snap fit into a valve housing thereby hermetically sealing the bag to the valve housing via a gasket (alternatively the bag can be heat sealed to the valve insert). The bag is wound around the core tube to create a BoV assembly having a diameter of approximately 24 mm outer diameter. An elastic sleeve of approximately 34 mm outer diameter, 10.3 mm wall thickness (un-stretched) and 375 mm length made of elastomeric composite A is stretched to insert the BoV assembly and the BoV is inserted into the elastic sleeve to create the SBoV. The SBoV is inserted through a standard fitment of 48 mm outer diameter on a large volume flexible container of 10 liter volume having a L/D=2:1, outer diameter sidewall of approximately 170 mm, and made of flexible film B. A 48 mm retaining ring is tightened onto the fitment screw threads to secure the valve seat/SBoV assembly. The 25% pre-expansion of the sleeve over the BoV creates a positive pressure of approximately 0.3 bar when empty. Fluid composition can then be loaded through the valve into the bag and the sleeve is expanded to the outer wall of the large volume flexible container representing a 400% expansion and creating a pressure of approximately 8 bar. An actuator can be then added to the valve to deliver the desired stream/spray for the application. As fluid composition exits the container both the bag and the flexible container collapse.

Example 3

20 L

A valve housing having a spring valve is crimped to an approximately 63 mm outer diameter valve seat. A rigid core tube (HDPE, 5 mm wall), hollow but closed, of approximately 26.5 mm outer diameter×430 mm length having a round end and an exit hole at the top is inserted into a pouch bag made with a 250 μm coextruded polyethylene film consisting of ELITE™ 5400G enhanced polyethylene and 50 μm AFFINITY™ PF1146G sealant with opening tight around the tube and attached to a valve insert that is snap fit into a valve housing thereby hermetically sealing the bag to the valve housing via a gasket (alternatively the bag can be heat sealed to the valve insert). The bag is wound around the core tube to create a BoV assembly having a diameter of approximately 30.5 mm outer diameter. An elastic sleeve of approximately 43 mm outer diameter, 13 mm wall thickness (un-stretched) and 500 mm length made of vulcanized elastomeric composite A is stretched to insert the BoV assembly and the BoV is inserted into the elastic sleeve to create the SBoV. The SBoV is inserted through a standard fitment of 63 mm outer diameter on a large volume flexible container of 20 liter volume having a L/D=2:1, outer diameter sidewall of approximately 215 mm, and made of flexible film B. A 63 mm retaining ring is tightened onto the fitment screw threads to secure the valve seat/SBoV assembly. The 25% pre-expansion of the sleeve over the BoV creates a positive pressure of approximately 0.3 bar when empty. Product can then be loaded through the valve into the bag and the sleeve is expanded to the outer wall of the large volume flexible container representing a 400% expansion and creating a pressure of approximately 8 bar. An actuator can be then added to the valve to deliver the desired stream/spray for the application. As product exits the container both the bag and the flexible container collapse.

It is specifically intended that the present disclosure not be limited to the embodiments and illustrations contained herein, but include modified forms of those embodiments including portions of the embodiments and combinations of elements of different embodiments as come with the scope of the following claims.

The invention claimed is:

1. A device for dispensing a fluid under pressure comprising:

(A) a flexible container comprising four panels, each panel formed from a flexible multilayer film composed of one or more polymeric materials, the four panels forming
  (i) a body, and
  (ii) a neck;

(B) a fitment comprising a top portion and a base, the base composed of a polymeric material, the base sealed in the neck;

(C) a sleeve bag on valve assembly (SBoV) comprising
  (i) a valve housing,
  (ii) a core tube attached to the valve housing,
  (iii) a bag around the core tube, the bag attached to the valve housing,
  (iv) a sleeve surrounding the bag and the core tube, and
  (v) a valve seat;

(D) the SBoV inserted through the fitment and located in the body; and (E) the valve seat attached to the fitment.

2. The device of claim 1 wherein the flexible container is a large volume flexible container.

3. The device of claim 1 wherein the flexible container comprises a front panel, a back panel, a first gusset panel, a second gusset panel, and a bottom segment; and the panels and the bottom segment support the flexible container in an upright position when the bag contains a fluid composition for dispensing.

4. The device of claim 1 wherein the flexible container comprises a plurality of peripheral heat seals.

5. The device of claim 1 wherein the flexible container has a length (L) and a width (Wi), and the flexible container has a L:Wi ratio from 1.0 to 5.0.

6. The device of claim 1 wherein the bag has an expanded volume from 0.5 L to 30 L.

7. The device of claim 1 wherein the sleeve has an unexpanded thickness from 3.0 mm to 20.0 mm and the sleeve, at 400% elongation, has a tensile modulus of at least 20 MPa.

8. The device of claim 1 wherein the bag has an expanded volume from 0.5 L to 30.0 L, and the sleeve has an unexpanded thickness from 3.0 mm to 20.0 mm.

9. The device of claim 1 wherein the fitment base has a circular cross section with a diameter (d) and a wall thickness (WT), wherein the d/WT ratio (in mm) is from 5 to 450.

10. The device of claim 1 wherein the flexible container comprises at least one handle.

11. The device of claim 1 comprising a retaining ring for securing the valve seat to the fitment.

12. The device of claim 11 wherein the valve seat is sandwiched within a threaded engagement between the retaining ring and the fitment.

13. The device of claim 11 wherein the valve seat is sandwiched within a snap-on engagement between the retaining ring and the fitment.

14. The device of claim 1 wherein the bag contains a fluid composition.

15. The device of claim 1 wherein the volume amount of the fluid composition present in the bag is from 70% to 95% the volume of the flexible container.

16. The device of claim 1 where the flexible multilayer film has a thickness from 100 μm to 400 μm.

17. The device of claim 1 wherein the fitment base has a wall thickness from 0.15 mm to 2.0 mm.

18. The device of claim 1 wherein the bag is refillable.

* * * * *